US009613555B2

(12) United States Patent
Chen et al.

(10) Patent No.: US 9,613,555 B2
(45) Date of Patent: Apr. 4, 2017

(54) PIXEL DRIVING CIRCUIT INCLUDING SIGNAL SPLITTING CIRCUITS, DRIVING METHOD, DISPLAY PANEL, AND DISPLAY DEVICE

(71) Applicants: BOE TECHNOLOGY GROUP CO., LTD., Beijing (CN); BEIJING BOE DISPLAY TECHNOLOGY CO., LTD., Beijing (CN)

(72) Inventors: Huabin Chen, Beijing (CN); Jianfeng Yuan, Beijing (CN)

(73) Assignees: BOE TECHNOLOGY GROUP CO., LTD. (CN); BEIJING BOE DISPLAY TECHNOLOGY CO., LTD. (CN)

( * ) Notice: Subject to any disclaimer, the term of this patent is extended or adjusted under 35 U.S.C. 154(b) by 243 days.

(21) Appl. No.: 14/317,130

(22) Filed: Jun. 27, 2014

(65) Prior Publication Data

US 2015/0302785 A1 Oct. 22, 2015

(30) Foreign Application Priority Data

Apr. 16, 2014 (CN) ..... 2014 1 0153106

(51) Int. Cl.
*G09G 3/36* (2006.01)
*G09G 3/20* (2006.01)

(52) U.S. Cl.
CPC ..... *G09G 3/20* (2013.01); *G09G 3/3674* (2013.01); *G09G 3/3677* (2013.01);
(Continued)

(58) Field of Classification Search
CPC ... G09G 2310/0297; G09G 2310/0218; G09G 3/3677; G09G 3/3674; G09G 2310/0267
(Continued)

(56) References Cited

U.S. PATENT DOCUMENTS

2006/0007195 A1* 1/2006 Hu ..... G09G 3/3648 345/204
2009/0079669 A1* 3/2009 Huang ..... G09G 3/3677 345/30

FOREIGN PATENT DOCUMENTS

CN 101261376 A 9/2008
CN 101976550 A * 2/2011 ..... G09G 3/36
(Continued)

OTHER PUBLICATIONS

Office Action in Chinese Patent Application No. 201410153106.5, dated Nov. 4, 2015.
(Continued)

*Primary Examiner* — Chanh Nguyen
*Assistant Examiner* — Yuzhen Shen
(74) *Attorney, Agent, or Firm* — Bakerhostetler LLP

(57) ABSTRACT

The present disclosure provides a pixel driving circuit, a driving method, a display panel and a display device. The pixel driving circuit comprises a plurality of signal splitting systems which include a scanning signal input interface configured to receive an original scanning signal with a width of MT, an auxiliary control signal input interface configured to receive an auxiliary control signal, and signal output interfaces connected to M rows of gate lines in an one-to-one correspondence manner. The signal splitting system is configured to split the original scanning signal with a width of MT into M gate driving signals with a width of a gate line turn-on time T, and output the gate driving signals to the M rows of gate lines sequentially via the output interfaces. M is not less than 2.

10 Claims, 12 Drawing Sheets

(52) U.S. Cl.
CPC ..... *G09G 2310/0218* (2013.01); *G09G 2310/0267* (2013.01); *G09G 2310/0297* (2013.01)

(58) Field of Classification Search
USPC ..... 345/84
See application file for complete search history.

(56) References Cited

FOREIGN PATENT DOCUMENTS

| | | | | | |
|---|---|---|---|---|---|
| CN | 102054446 | A | * | 5/2011 | ..... G09G 3/20 |
| CN | 102881248 | A | * | 1/2013 | ..... G09G 3/20 |
| CN | 103700354 | A | | 4/2014 | |
| KR | 20050039183 | A | | 4/2005 | |
| KR | 20050065815 | A | | 6/2005 | |
| KR | 20050065817 | A | | 6/2005 | |

OTHER PUBLICATIONS

Office Action in Chinese Patent Application No. 201410153106.5, dated Aug. 10, 2016.

* cited by examiner

PIXEL DRIVING CIRCUIT INCLUDING SIGNAL SPLITTING CIRCUITS, DRIVING METHOD, DISPLAY PANEL, AND DISPLAY DEVICE

CROSS-REFERENCE TO RELATED APPLICATION

This application claims priority to Chinese Patent Application No. 201410153106.5 filed on Apr. 16, 2014, the disclosures of which are incorporated in their entirety by reference herein.

TECHNICAL FIELD

The present invention relates to the field of display technology, in particular to a pixel driving circuit, a driving method, a display panel and a display device.

BACKGROUND

Along with the development of society and the improvement in the people's living standards, flat panel TVs have been widely used nowadays. In order to meet the market demands in a better manner, it is required not only to provide large-size flat panel TVs but also to provide better design. As a result, a "narrow-bezel" TV has been launched.

Currently, the "narrow-bezel" design has gradually become a trend for the flat panel TVs. Such a "narrow-bezel" TV not only can produce well visual effect but also can provide an elaborate appearance for the entire TV.

Hence, how to achieve the "narrow-bezel" design has become a direction of the display technology.

SUMMARY

An object of an embodiment of the present invention is to provide a pixel driving circuit, a driving method, a display panel and a display device, so as to control at least two rows of gate lines by one scanning signal line, thereby to reduce more than half of the scanning signal lines, reduce a wiring region for the scanning signal lines and provide a "narrow-bezel" display device.

In one aspect, the present disclosure provides a pixel driving circuit, comprising one or more signal splitting systems, each signal splitting system corresponding to continuous M rows of gate lines, M being not less than 2.

The signal splitting system comprises:

a scanning signal input interface configured to receive an original scanning signal with a time width of MT and connected to an original scanning signal transmission line;

an auxiliary control signal input interface configured to receive an auxiliary control signal and connected to an auxiliary control signal transmission line; and signal output interfaces connected to the M rows of gate lines in a one-to-one correspondence manner.

The signal splitting system is configured to split the original scanning signal with a width of MT into M gate driving signals with a width of a gate line turn-on time T, and output the gate driving signals to the M rows of gate lines sequentially via the output interfaces.

Alternatively, M has a value of $2^n$, and n is not less than 1.

The signal splitting system comprises n levels of signal splitting subsystems. An $n^{th}$-level signal splitting subsystem comprises $2^{n-1}$ signal decomposition modules, each of which is configured to decompose the received signal into two continuous signals. The signal output from the signal decomposition module has a width half of the signal input thereinto.

Alternatively, the signal decomposition module comprises a scanning signal input end, at least one auxiliary control signal input end, two signal output ends, and at least one switch unit.

The scanning signal input end of the signal decomposition module in a first-level signal splitting subsystem is connected to the original scanning signal transmission line and configured to receive the original scanning signal. The scanning signal input end of the signal decomposition module in the signal splitting subsystems other than the first-level signal splitting subsystem is connected to the signal output end of the signal decomposition module in a previous-level signal splitting subsystem and configured to receive a signal output from the signal decomposition module in the previous-level signal splitting subsystem.

The auxiliary control signal input end is connected to the auxiliary control signal transmission line and configured to receive the auxiliary control signal. The auxiliary control signal input ends are arranged in one-to-one correspondence with the switch units. When there is a plurality of auxiliary control signal input ends, they are connected to different auxiliary control signal transmission lines and receive different auxiliary control signals.

The two signal output ends of the signal decomposition module in the signal splitting subsystems other than a last-level signal splitting subsystem are connected to the scanning signal input ends of two adjacent signal decomposition modules in a next-level signal splitting subsystem, respectively. The two signal output ends of the signal decomposition module in the last-level signal splitting subsystem are connected to the two adjacent rows of gate lines, respectively.

One of the at least one switch unit is connected to the scanning signal input end, the auxiliary control signal input end and the signal output end.

Preferably, the signal decomposition module comprises a switch unit, an auxiliary control signal input end, a first signal output end and a second signal output end. The switch unit is connected to the scanning signal input end, the auxiliary control signal input end and the first signal output end. The second signal output end is connected to the scanning signal input end.

Alternatively, the signal decomposition module comprises a first switch unit, a second switch unit, a first auxiliary control signal input end, a second auxiliary control signal input end, the first signal output end, and the second signal output end. The first switch unit is connected to the scanning signal input end, the first auxiliary control signal input end and the first signal output end. The second switch unit is connected to the scanning signal input end, the second auxiliary control signal input end and the second signal output end.

Alternatively, the signal splitting system comprises the first-level signal splitting subsystem and a second-level signal splitting subsystem. The first-level signal splitting subsystem includes a first signal decomposition module. The second-level signal splitting subsystem includes a second signal decomposition module and a third signal decomposition module.

The first signal decomposition module includes a first switch unit and a second switch unit. The first switch unit is connected to a scanning signal input end of the first signal decomposition module, the first auxiliary control signal input end, and a first signal output end of the first signal decomposition module. The second switch unit is connected to the scanning signal input end of the first signal decomposition module, the second auxiliary control signal input end, and a second signal output end of the first signal decomposition module. The scanning signal input end of the first signal decomposition module is connected to the original scanning signal transmission line.

The second signal decomposition module includes a third switch unit and a fourth switch unit. The third switch unit is connected to a scanning signal input end of the second signal decomposition module, a third auxiliary control signal input end, and a first signal output end of the second signal decomposition module. The fourth switch unit is connected to the scanning signal input end of the second signal decomposition module, a fourth auxiliary control signal input end, and a second signal output end of the second signal decomposition module. The scanning signal input end of the second signal decomposition module is connected to the first signal output end of the first signal decomposition module. The first signal output end of the second decomposition module is connected to a first gate line, and the second signal output end of the second signal decomposition module is connected to a second gate line.

The third signal decomposition module includes a fifth switch unit and a sixth switch unit. The fifth switch unit is connected to a scanning signal input end of the third signal decomposition module, the third auxiliary control signal input end, and a first signal output end of the third signal decomposition module. The sixth switch unit is connected to the scanning signal input end of the third signal decomposition module, the fourth auxiliary control signal input end, and a second signal output end of the third signal decomposition module. The scanning signal input end of the third signal decomposition module is connected to the second signal output end of the first signal decomposition module. the first signal output end of the third signal decomposition module is connected to a third gate line, and the second signal output end of the third signal decomposition module is connected to a fourth gate line.

Alternatively, M has a value of 2n, and n is not less than 1. The signal splitting system comprises a control subsystem and the signal splitting subsystem.

The control subsystem includes a scanning signal input end, and n auxiliary control signal input ends, n signal output ends and n switch units which are arranged in a one-to-one correspondence manner. The scanning signal input end is connected to the original scanning signal transmission line, the n auxiliary control signal input ends are connected to different auxiliary control signal transmission lines, and the n signal output ends are connected to the signal splitting subsystem. The control subsystem is configured to control the receipt of the original scanning signal by the signal splitting subsystem.

The signal splitting subsystem includes n signal decomposition modules, each of which is configured to decompose the received original scanning signal into two continuous signals and output them to the corresponding ones of the 2n rows of gate lines. The signal output from the signal decomposition module has a width half the original scanning signal.

Alternatively, the control subsystem includes a first switch unit, a second switch unit and a third switch unit. The first switch unit is connected to the scanning signal input end, a first auxiliary control signal input end and a first signal output end of the control subsystem, and the first signal output end is connected to the signal splitting subsystem. The second switch unit is connected to the scanning signal input end, a second auxiliary control signal input end and a second signal output end of the control subsystem, and the second signal output end is connected to the signal splitting subsystem. The third switch unit is connected to the scanning signal input end, a third auxiliary signal input end and a third signal output end of the control subsystem, and the third signal output end is connected to the signal splitting subsystem.

The signal splitting subsystem includes a first signal decomposition module, a second signal decomposition module and a third signal decomposition module.

The first signal decomposition module includes a fourth switch unit and a fifth switch unit. The fourth switch unit is connected to the scanning signal input end of the first signal decomposition module, the fourth auxiliary control signal input end, and the first signal output end of the first signal decomposition module. The second switch unit is connected to the scanning signal input end of the first signal decomposition module, a fifth auxiliary control signal input end, and the second signal output end of the first signal decomposition module. The scanning signal input end of the first signal decomposition module is connected to the first signal output end of the control subsystem. The first signal output end of the first signal decomposition module is connected to the first gate line, and the second signal output end of the first signal decomposition module is connected to the second gate line.

The second signal composition module includes a sixth switch unit and a seventh switch unit. The sixth switch unit is connected to the scanning signal input end of the second signal decomposition module, the fourth auxiliary control signal input end, and the first signal output end of the second signal decomposition module. The seventh switch unit is connected to the scanning signal input end of the second signal decomposition module, the fifth auxiliary control signal input end, and the second signal output end of the second signal decomposition module. The scanning signal input end of the second signal decomposition module is connected to the second signal output end of the control subsystem. The first signal output end of the second signal decomposition module is connected to the third gate line, and the second signal output end of the second decomposition module is connected to the fourth gate line.

The third signal decomposition module includes an eighth switch unit and a ninth switch unit. The eighth switch unit is connected to the scanning signal input end of the third signal decomposition module, the fourth auxiliary control signal input end, and the first signal output end of the third signal decomposition module. The ninth switch unit is connected to the scanning signal input end of the third signal decomposition module, the fifth auxiliary control signal input end, and the second signal output end of the third signal decomposition module. The scanning signal input end of the third signal decomposition module is connected to the third signal output end of the control subsystem. The first signal output end of the third signal decomposition module is connected to a fifth gate line, and the second signal output end of the third signal decomposition module is connected to a sixth gate line.

Alternatively, the switch unit includes a first TFT and a second TFT. A gate electrode of the first TFT is connected to the auxiliary control signal input end, and a source electrode thereof is connected to the scanning signal input end. A gate electrode of the second TFT is connected to the scanning signal input end, and a source electrode thereof is connected to the auxiliary control signal input end. A drain electrode of the first TFT and a drain electrode of the second TFT are connected to the signal output end.

In another aspect, the present disclosure provides a driving method, comprising the step of:

under the control of an original scanning signal with a time width of MT and one or more auxiliary control signals, splitting, by a signal splitting system, the original scanning signal with a width of MT into M gate driving signals with a width of a gate line turn-on time T, and outputting the gate driving signals to M rows of gate lines sequentially.

Preferably, the step of under the control of an original scanning signal with a width of MT and an auxiliary control signal, splitting, by a signal splitting system, the original scanning signal with a width of MT into M gate driving signals with a width of a gate line turn-on time T, and outputting the gate driving signals to M rows of gate lines sequentially comprises:

at a first stage, inputting, by a scanning signal input interface, a high level signal, inputting, by an auxiliary control signal input interface, a high level signal, and outputting, by the signal splitting system, a high level gate driving signal to the gate lines in the first and second rows;

at a second stage, inputting, by the scanning signal input interface, a high level signal, inputting, by the auxiliary control signal input interface, a low level signal, and outputting, by the signal splitting system, a low level gate driving signal to the gate line in the first row and a high level gate driving signal to the gate line in the second row; and at a third stage, inputting, by the scanning signal input interface, a low level signal, inputting, by the auxiliary control signal input interface, a high level signal, and outputting, by the signal splitting system, a low level gate driving signal to the gate line in the first row and a low level gate driving signal to the gate line in the second row.

Alternatively, the step of under the control of an original scanning signal with a width of MT and a plurality of auxiliary control signals, splitting, by a signal splitting system, the original scanning signal with a width of MT into M gate driving signals with a width of a gate line turn-on time T, and outputting the gate driving signals to M rows of gate lines sequentially comprises:

at a first stage, the plurality of auxiliary control signals being a first auxiliary control signal and a second auxiliary control signal, inputting, by the scanning signal input interface, a high level signal, inputting, by a first auxiliary control signal input interface, a high level signal, inputting, by a second auxiliary control signal input interface, a low level signal, and outputting, by the signal splitting system, a high level gate driving signal to the gate line in the first row and a low level gate driving signal to the gate line in the second row;

at a second stage, inputting, by the scanning signal input interface, a high level signal, inputting, by the first auxiliary control signal input interface, a low level signal, inputting, by the second auxiliary control signal input interface, a high level signal, and outputting, by the signal splitting system, a low level gate driving signal to the gate line in the first row and a high level gate driving signal to the gate line in the second row; and at a third stage, inputting, by the scanning signal input interface, a low level signal, inputting, by the first auxiliary control signal input interface, a high signal, inputting, by the second auxiliary control signal input interface, a low level signal, outputting, by the signal splitting system, a low level gate driving signal to the gate line in the first row, and not outputting, by the signal splitting system, a gate driving signal to the gate line in the second row.

Alternatively, the step of, under the control of an original scanning signal with a width of MT and a plurality of auxiliary control signals, splitting, by a signal splitting system, the original scanning signal with a width of MT into M gate driving signals with a width of a gate line turn-on time T, and outputting the gate driving signals to M rows of gate lines sequentially comprises:

at a first stage, the plurality of auxiliary control signals being a first auxiliary control signal, a second auxiliary control signal, a third auxiliary control signal and a fourth auxiliary control signal, inputting, by the scanning signal input interface, a high level signal, inputting, by the first auxiliary control signal input interface, a high level signal, inputting, by the second auxiliary control signal input interface, a low level signal, inputting, by a third auxiliary control signal input interface, a high level signal, inputting, by a fourth auxiliary control signal input interface, a low level signal, outputting, by the signal splitting system, a high level gate driving signal to a first gate line and a low level gate driving signal to second and third gate lines, and not outputting, by the signal splitting system, a gate driving signal to a fourth gate line;

at a second stage, inputting, by the scanning signal input interface, a high level signal, inputting, by the first auxiliary control signal input interface, a high level signal, inputting, by the second auxiliary control signal input interface, a low level signal, inputting, by the third auxiliary control signal input interface, a low level signal, inputting, by the fourth auxiliary control signal input interface, a high level signal, outputting, by the signal splitting system, a high level gate driving signal to the second gate line and a low level gate driving signal to the first and fourth gate lines, and not outputting, by the signal splitting system, a gate driving signal to the third gate line;

at a third stage, inputting, by the scanning signal input interface, a high level signal, inputting, by the first auxiliary control signal input interface, a low level signal, inputting, by the second auxiliary control signal input interface, a high level signal, inputting, by the third auxiliary control signal input interface, a high level signal, inputting, by the fourth auxiliary control signal input interface, a low level signal, outputting, by the signal splitting system, a high level gate driving signal to the third gate line and a low level gate driving signal to the first and fourth gate lines, and not outputting, by the signal splitting system, a gate driving signal to the second gate line;

at a fourth stage, inputting, by the scanning signal input interface, a high level signal, inputting, by the first auxiliary control signal input interface, a low level signal, inputting, by the second auxiliary control signal input interface, a high level signal, inputting, by the third auxiliary control signal input interface, a low level signal, inputting, by the fourth auxiliary control signal input interface, a high level signal, outputting, by the signal splitting system, a high level gate driving signal to the fourth gate line and a low level gate driving signal to the second and third gate lines, and not outputting, by the signal splitting system, a gate driving signal to the first gate line; and at a fifth stage, inputting, by the scanning signal input interface, a low level signal, inputting, by the first auxiliary control signal input interface, a high level signal, inputting, by the second auxiliary control signal input interface, a low level signal, inputting, by the third auxiliary control signal input interface, a high level signal, inputting, by the fourth auxiliary control signal input interface, a low level signal, outputting, by the signal splitting system, a low level gate driving signal to the first gate line, and not outputting, by the signal splitting system, a gate driving signal to the second, third and fourth gate lines.

Alternatively, the step of, under the control of an original scanning signal with a width of MT and a plurality of auxiliary control signals, splitting, by a signal splitting system, the original scanning signal with a width of MT into M gate driving signals with a width of a gate line turn-on time T, and outputting the gate driving signals to M rows of gate lines sequentially comprises:

at a first stage, the plurality of auxiliary control signals being a first auxiliary control signal, a second auxiliary control signal, a third auxiliary control signal, a fourth auxiliary control signal and a fifth auxiliary control signal, inputting, by the scanning signal input interface, a high level signal, inputting, by the first auxiliary control signal input interface, a high level signal, inputting, by the second auxiliary control signal input interface, a low level signal, inputting, by the third auxiliary control signal input interface, a low level signal, inputting, by the fourth auxiliary control signal input interface, a high level signal, inputting, by a fifth auxiliary control signal input interface, a low level signal, outputting, by a signal splitting subsystem, a high level gate driving signal to the first gate line and a low level gate driving signal to the second and third gate lines and a fifth gate line, and not outputting, by the signal splitting subsystem, a gate driving signal to the fourth gate line and a sixth gate line;

at a second stage, inputting, by the scanning signal input interface, a high level signal, inputting, by the first auxiliary control signal input interface, a high level signal, inputting, by the second auxiliary control signal input interface, a low level signal, inputting, by the third auxiliary control signal input interface, a low level signal, inputting, by the fourth auxiliary control signal input interface, a low level signal, inputting, by the fifth auxiliary control signal input interface, a high level signal, outputting, by the signal splitting subsystem, a high level gate driving signal to the second gate line and a low level gate driving signal to the first, fourth and sixth gate lines, and not outputting, by the signal splitting system, a gate driving signal to the third and fifth gate lines;

at a third stage, inputting, by the scanning signal input interface, a high level signal, inputting, by the first auxiliary control signal input interface, a low level signal, inputting, by the second auxiliary control signal input interface, a high level signal, inputting, by the third auxiliary control signal input interface, a low level signal, inputting, by the fourth auxiliary control signal input interface, a high level signal, inputting, by the fifth auxiliary control signal input interface, a low level signal, outputting, by the signal splitting subsystem, a high level gate driving signal to the third gate line and a low level gate driving signal to the first, fourth and fifth gate lines, and not outputting, by the signal splitting subsystem, a gate driving signal to the second and sixth gate lines;

at a fourth stage, inputting, by the scanning signal input interface, a high level signal, inputting, by the first auxiliary control signal input interface, a low level signal, inputting, by the second auxiliary control signal input interface, a high level signal, inputting, by the third auxiliary control signal input interface, a low level signal, inputting, by the fourth auxiliary control signal input interface, a low level signal, inputting, by the fifth auxiliary control signal input interface, a high level signal, outputting, by the signal splitting subsystem, a high level gate driving signal to the fourth gate line and a low level gate driving signal to the second, third and sixth gate lines, and not outputting, by the signal splitting subsystem, a gate driving signal to the first and fifth gate lines;

at a fifth stage, inputting, by the scanning signal input interface, a high level signal, inputting, by the first auxiliary control signal input interface, a low level signal, inputting, by the second auxiliary control signal input interface, a low level signal, inputting, by the third auxiliary control signal input interface, a high level signal, inputting, by the fourth auxiliary control signal input interface, a high level signal, inputting, by the fifth auxiliary control signal input interface, a low level signal, outputting, by the signal splitting subsystem, a high level gate driving signal to the fifth gate line and a low level gate driving signal to the first, third and sixth gate lines, and not outputting, by the signal splitting subsystem, a gate driving signal to the second and fourth gate lines;

at a sixth stage, inputting, by the scanning signal input interface, a high level signal, inputting, by the first auxiliary control signal input interface, a low level signal, inputting, by the second auxiliary control signal input interface, a low level signal, inputting, by the third auxiliary control signal input interface, a high level signal, inputting, by the fourth auxiliary control signal input interface, a low level signal, inputting, by the fifth auxiliary control signal input interface, a high level signal, outputting, by the signal splitting subsystem, a high level gate driving signal to the sixth gate line and a low level gate driving signal to the second, fourth and fifth gate lines, and not outputting, by the signal splitting subsystem, a gate driving signal to the first and third gate lines; and at a seventh stage, inputting, by the scanning signal input interface, a low level signal, inputting, by the first auxiliary control signal input interface, a high level signal, inputting, by the second auxiliary control signal input interface, a low level signal, inputting, by the third auxiliary control signal input interface, a low level signal, inputting, by the fourth auxiliary control signal input interface, a high level signal, inputting, by the fifth auxiliary control signal input interface, a low level signal, outputting, by the signal splitting subsystem, a low level gate driving signal to the first gate line, and not outputting, by the signal splitting subsystem, a gate driving signal o the second, third, fourth, fifth and sixth gate lines.

In yet another aspect, the present disclosure provides a display panel comprising the above-mentioned pixel driving circuit.

In yet another aspect, the present disclosure provides a display device comprising the above-mentioned display panel.

According to the pixel driving circuit, the driving method, the display panel and the display device of the present invention, the pixel driving circuit is provided with a plurality of signal splitting systems comprising the scanning signal input interface for receiving the original scanning signal with a width of MT, the auxiliary control signal input interfaces for receiving the auxiliary control signals and the signal output interfaces connected to the M rows of gate lines in a one-to-one correspondence manner. The signal splitting system is configured to split the original scanning signal with a width of MT into M gate driving signals with a width of the gate line turn-on time T, and output the gate driving signals to the M rows of gate lines sequentially via the output interfaces. As a result, it is able to control at least two rows of gate lines by one scanning signal line, thereby to reduce more than half of the scanning signal lines, reduce a wiring region for the scanning signal lines and provide a "narrow-bezel" display device.

DETAILED DESCRIPTION

In order to make the objects, the technical solutions and the advantages of the present invention more apparent, the present invention will be described in a clear and complete manner hereinafter in conjunction with the drawings. Obviously, the following embodiments are merely a part of, rather than all of, the embodiments of the present invention, and based on these embodiments, it is able for a person skilled in the art to obtain the other embodiments, which also fall within the scope of the present invention.

Unless otherwise defined, the technical or scientific terms used herein shall have the common meanings understandable for a person of ordinary skills in the art. Such words as "first" and "second" in the specification and the appended claims are merely used to differentiate different components from each other, rather than to show any order, number or significance. Similarly, such expressions as "one" or "a/an" are merely used to indicate that there is at least one part/component, rather than to define the number thereof. Such words as "connect" and "couple" may include, apart from physical or mechanical connection, electrical connection too, whether direct or indirect. Such words as "up", "down", "left" and "right" are merely used to indicate the relative position relationship, and when an absolute position of an object is changed, the relative position relationship will be changed correspondingly.

An embodiment of the present invention provides a pixel driving circuit comprising a plurality of signal splitting systems 1, each corresponding to continuous M rows of gate lines, M being an integer not less than 2.

Figure 1:
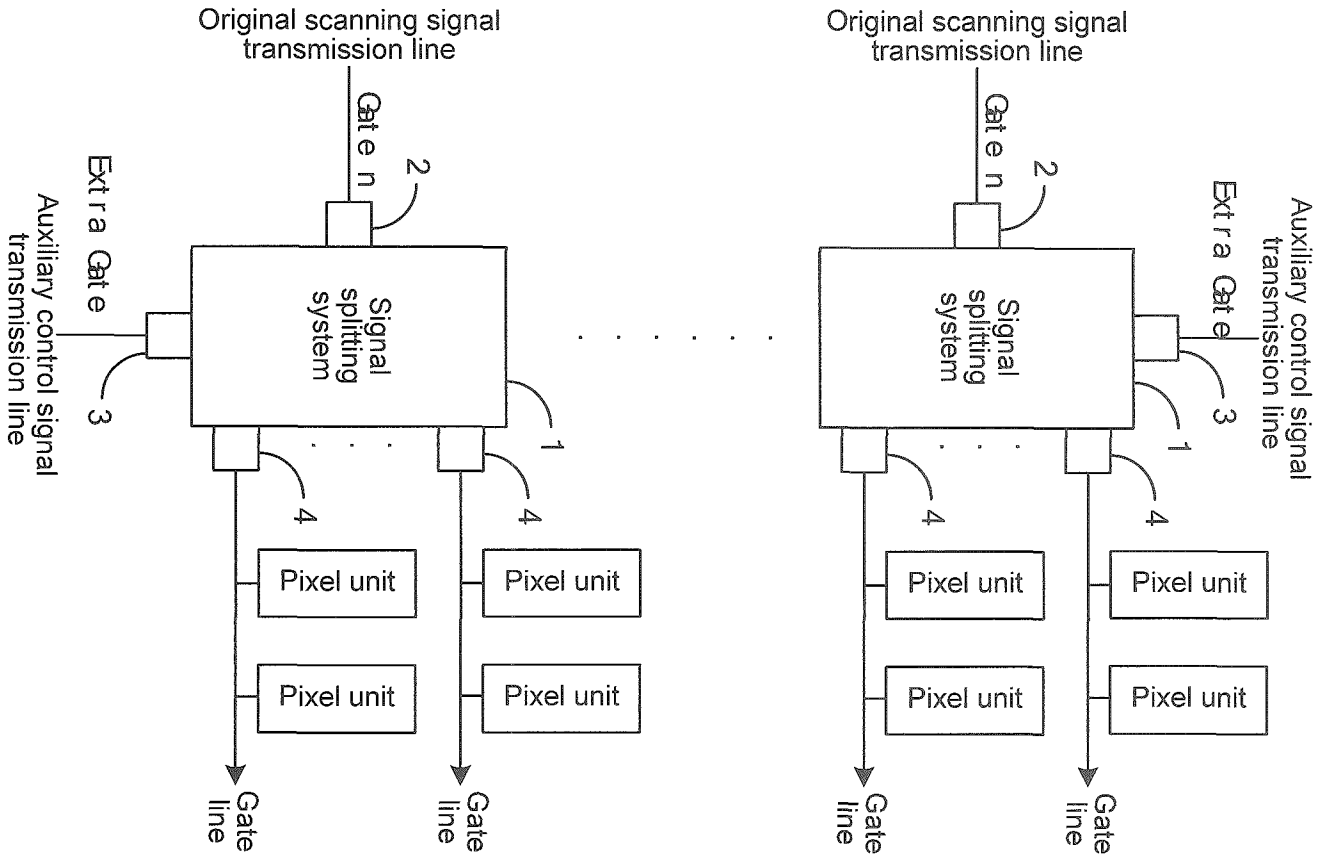
FIG. 1 is a schematic view showing a pixel driving circuit according to one embodiment of the present invention.

As shown in FIG. 1, the signal splitting system 1 may comprise:

a scanning signal input interface 2 configured to receive an original scanning signal (Gate n) with a time width of MT and connected to an original scanning signal transmission line;

an auxiliary control signal input interface 3 configured to receive an auxiliary control signal (Extra Gate) and connected to an auxiliary control signal transmission line (Extra Gate Line); and signal output interfaces 4 (OUT) connected to the M rows of gate lines in a one-to-one correspondence manner.

The signal splitting system is configured to split the original scanning signal with a width of MT into M gate driving signals with a width of a gate line turn-on time T, and output the gate driving signals to the M rows of gate lines sequentially via the output interfaces.

According to the pixel driving circuit of an embodiment of the present invention, it is able to control at least two rows of gate lines by one scanning signal line, thereby to reduce more than half of the scanning signal lines, reduce a wiring region for the scanning signal lines and provide a "narrow-bezel" display device.

The present disclosure further provides a driving method for use in the above-mentioned pixel driving circuit. The method comprises:

under the control of an original scanning signal with a time width of MT and an auxiliary control signal, splitting, by a signal splitting system 1, the original scanning signal with a width of MT into M gate driving signals with a width of a gate line turn-on time T, and outputting the gate driving signals to M rows of gate lines sequentially.

The implementation of the pixel driving circuit and the driving method in different embodiments will be described hereinafter.

In these embodiments, M may have a value of $2^n$, and n is not less than 1.

Figure 2:
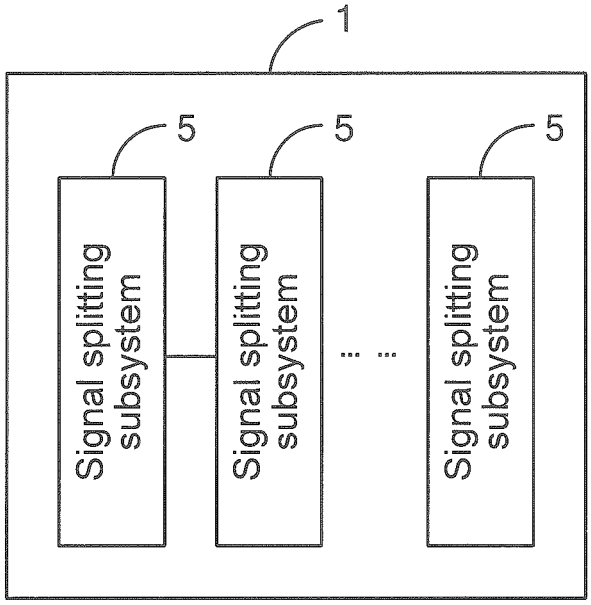
FIG. 2 is a schematic view showing a signal splitting system according to one embodiment of the present invention.

As shown in FIG. 2, the signal splitting system 1 may comprise n levels of signal splitting subsystems 5. An $n^{th}$-level signal splitting subsystem 5 comprises $2^{n-1}$ signal decomposition modules 6, each of which is configured to decompose the received signal into two continuous signals. The signal output from the signal decomposition module has a width half of the signal input into the signal decomposition module.

Figure 3:
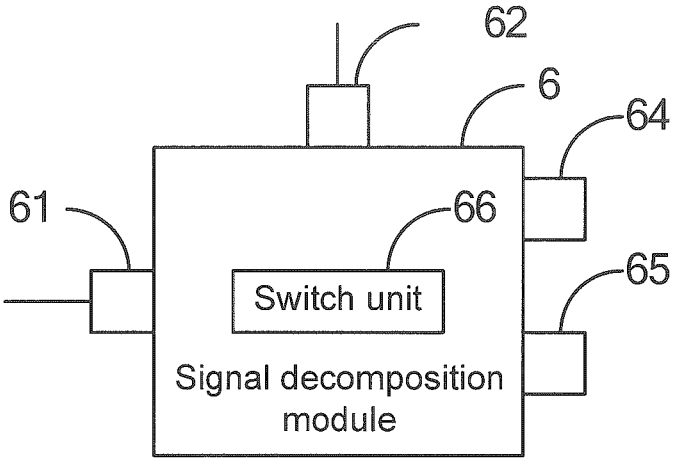
FIG. 3 is a schematic view showing a signal decomposition module according to one embodiment of the present invention.

As shown in FIG. 3, the signal splitting module 6 may comprise a scanning signal input end 61, at least one auxiliary control signal input end 62, two signal output ends 64, 65, and at least one switch unit 66.

In this embodiment, there are multiple levels of signal splitting subsystems 5 in the signal splitting system 1, so the connection relationship for the signal decomposition modules 6 in different signal splitting subsystems 5 is different.

The scanning signal input end 61 of the signal decomposition module 6 in a first-level signal splitting subsystem 5 is connected to the original scanning signal transmission line and configured to receive the original scanning signal. The scanning signal input end 61 of the signal decomposition module 6 in the signal splitting subsystems 5 other than the first-level signal splitting subsystem 5 is connected to the signal output end 64 or 65 of the signal decomposition module 6 in a previous-level signal splitting subsystem 5 and configured to receive a signal output from the signal decomposition module 6 in the previous-level signal splitting subsystem 5.

In this embodiment, the signal splitting subsystem 5 that is connected to the original scanning signal transmission line may be named as the first level, and the remaining signal splitting subsystems may be named sequentially, until the signal splitting subsystem connected to a gate line is named as the last level.

The auxiliary control signal input end 62 of the signal decomposition module 6 is connected to the auxiliary control signal transmission line and configured to receive the auxiliary control signal (Extra Gate). The auxiliary control signal input ends 62 are arranged in one-to-one correspondence with the switch units 66, i.e., one auxiliary control signal input end 62 is connected to one switch unit 66. When there is a plurality of auxiliary control signal input ends 62, they are connected to different auxiliary control signal transmission lines and receive different auxiliary control signals.

In this embodiment, the two signal output ends 64, 65 of the signal decomposition module 6 in the signal splitting subsystems 5 other than a last-level signal splitting subsystem 5 are connected to the scanning signal input ends 61 of two adjacent signal decomposition modules 6 in a next-level signal splitting subsystem 5, respectively. The two signal output ends 64, 65 of the signal decomposition module 6 in the last-level signal splitting subsystem 5 are connected to the two adjacent rows of gate lines, respectively.

In addition, in this embodiment, one switch unit 66 in the at least one switch unit 66 is connected to the scanning signal input end 61, one auxiliary control signal input end 62 and one signal output end 64 or 65 respectively.

Figure 4:
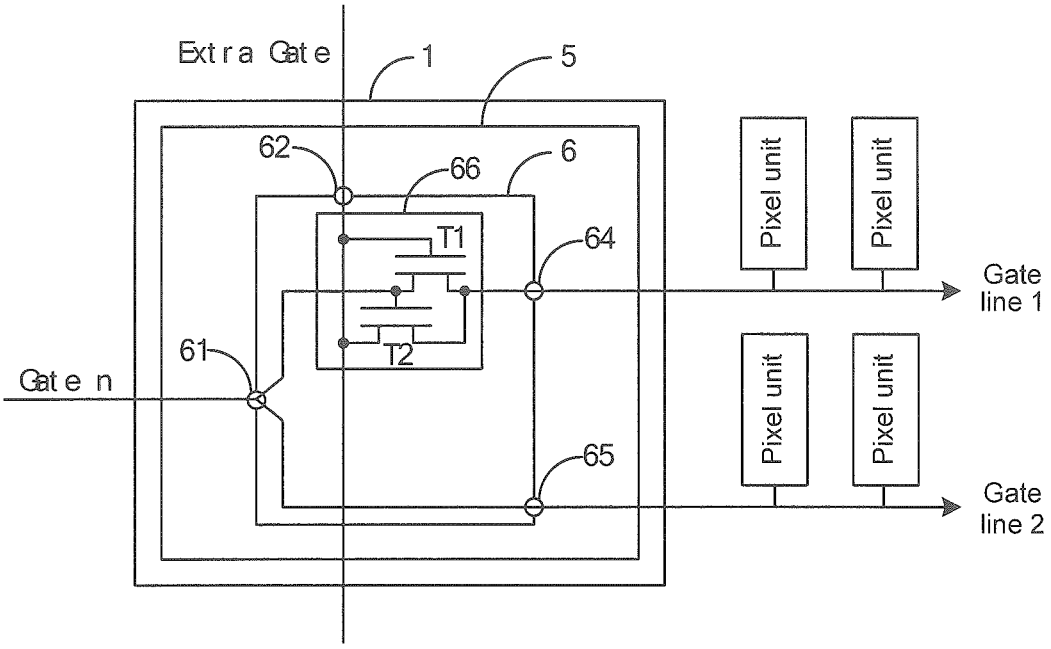
FIG. 4 is another schematic view showing the signal splitting system according to one embodiment of the present invention.

In an embodiment, as shown in FIG. 4, the signal splitting system 1 may comprise one level of the signal splitting subsystem 5, which may comprise one signal decomposition module 6.

The signal decomposition module 6 may comprise a switch unit 66, an auxiliary control signal input end 62, a first signal output end 64 and a second signal output end 65. The switch unit 66 is connected to the scanning signal input end 61, the auxiliary control signal input end 65 and the first signal output end 64. The second signal output end 65 is connected to the scanning signal input end 61.

As shown in FIG. 4, the switch unit 66 may comprise a first TFT T1 and a second TFT T2. A gate electrode of the first TFT T1 is connected to the auxiliary control signal input end 62, a source electrode thereof is connected to the scanning signal input end 61, and a drain electrode thereof is connected to the first signal output end 64. A gate electrode of the second TFT T2 is connected to the scanning signal input end 61, a source electrode thereof is connected to the auxiliary control signal input end 62, and a drain electrode thereof is connected to the first signal output end 64.

Figure 5:
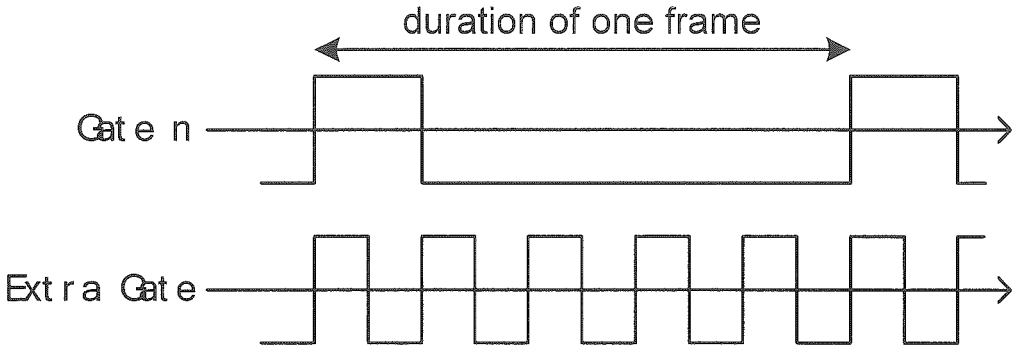
FIG. 5 is a time sequence diagram of signals input to the pixel driving circuit according to one embodiment of the present invention.
Figure 6:
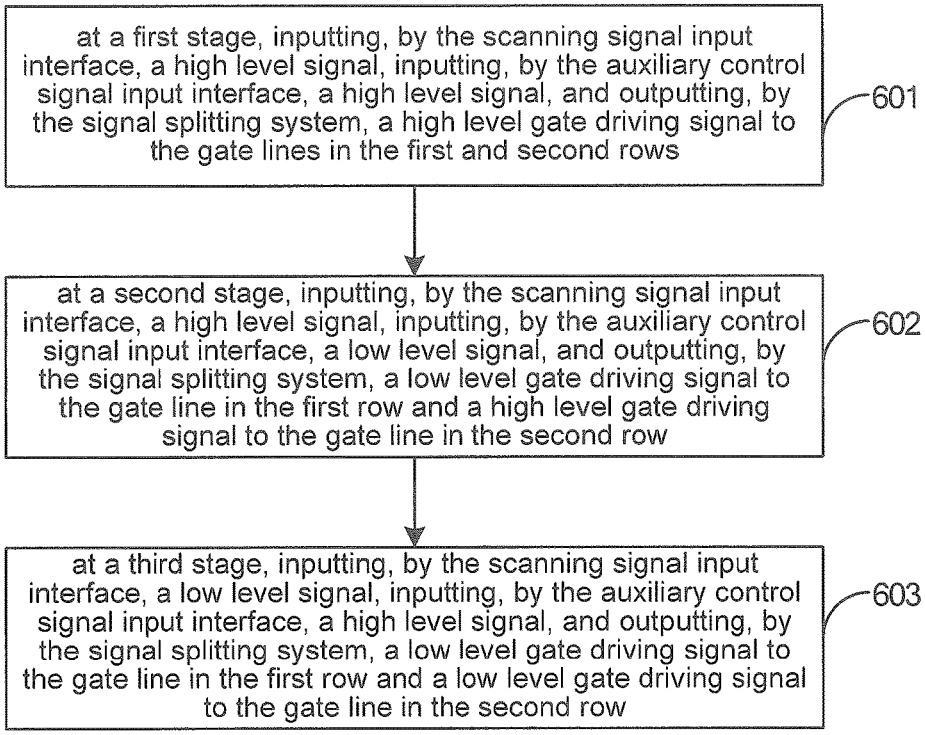
FIG. 6 is a flow chart of a driving method according to one embodiment of the present invention.

FIG. 5 is a sequence diagram of signals input to the pixel driving circuit. As shown in FIG. 6, the driving method may comprise the following steps.

Step 601: at a first stage, inputting, by the scanning signal input interface 2, a high level signal (i.e., Gate n is at a high level), inputting, by the auxiliary control signal input interface 3, a high level signal (i.e., Extra Gate is at a high level), and outputting, by the signal splitting system 1, a high level gate driving signal to the gate lines in the first and second rows.

In this embodiment, there is only one level of the signal splitting subsystem 5 in the signal splitting system 1, so the signal splitting subsystem may merely include one signal decomposition module 6. The scanning signal input end 61 of the signal decomposition module 6 is just the scanning signal input interface 2, and it is configured to receive the original scanning signal transmitted via the original scanning signal transmission line, i.e., Gate n. The auxiliary control signal input end 61 of the signal decomposition module 6 is just the auxiliary control signal input interface 3, and it is configured to receive the auxiliary control signal transmitted via the auxiliary control signal transmission line, i.e., Extra Gate. The output end 64 or 65 of the signal decomposition module 6 is just the signal output interface 4.

In the connection relationship as shown in FIG. 4, when Gate n and Extra Gate are at a high level, the first TFT T1 and the second TFT T2 are both in an on state, so the switch unit 66 is in an on state too. The high level signals Gate n and Extra Gate may be transmitted to a first gate line 1 via the switch unit 66 and the first output end 64. However, the second output end 65 is directly connected to the scanning signal input end 61, so the high level signal Gate n is directly transmitted to a second gate line 2.

Step 602: at a second stage, inputting, by the scanning signal input interface 2, a high level signal, inputting, by the auxiliary control signal input interface 3, a low level signal, and outputting, by the signal splitting system 1, a low level gate driving signal to the gate line in the first row and a high level gate driving signal to the gate line in the second row.

At this stage, Extra Gate is a low level signal, so the first TFT T1 is in an off state, and Gate n cannot be transmitted to the first gate line 1. Gate n is a high level signal, so the second TFT T2 is in the on state, and Extra Gate may be transmitted to the first gate line 1 via the switch unit 66 and the first output end 64. In other words, at the second stage, the low level signal is transmitted to the first gate line, while the high level signal Gate n is directly transmitted to the second gate line 2 via the second signal output end 65.

Step 603: at a third stage, inputting, by the scanning signal input interface 2, a low level signal, inputting, by the auxiliary control signal input interface 3, a high level signal, and outputting, by the signal splitting system 1, a low level gate driving signal to the gate line in the first row and a low level gate driving signal to the gate line in the second row.

At this stage, Extra Gate is a high level signal, so the first TFT T1 is in the on state, and Gate n may be transmitted to the first gate line 1. Gate n is a low level signal, so the second TFT T2 is in the off state, and Extra Gate cannot be transmitted to the first gate line 1. In other words, at the third stage, the low level signal is transmitted to the first gate line 1, while Gate n is directly transmitted to the second gate line 2 via the second output end 65.

Meanwhile, at this stage, the signal splitting system 1 corresponding to the original scanning signal transmission line Gate n+1 adjacent to Gate n starts to carry out the operation as mentioned in the first stage, i.e., outputting the high level signal Gate n+1 to a third gate line 3 as a gate driving signal, and outputting the low level signal Extra Gate2 to a fourth gate line 4 as a gate driving signal.

According to the pixel driving circuit of the present invention, the signal splitting system is provided, so as to reduce half of the scanning signal lines in the case that one auxiliary control signal transmission line is added, thereby to provide a "narrow-bezel" display device.

In this embodiment, the high level gate driving signal is output by the signal splitting system 1 to the second gate line 2 at both the first and second stages. The gate driving signal may be used to charge a capacitor in the pixel circuit, and the capacitor will be charged twice, so the normal display of the pixel circuit will not be affected.

Figure 7:
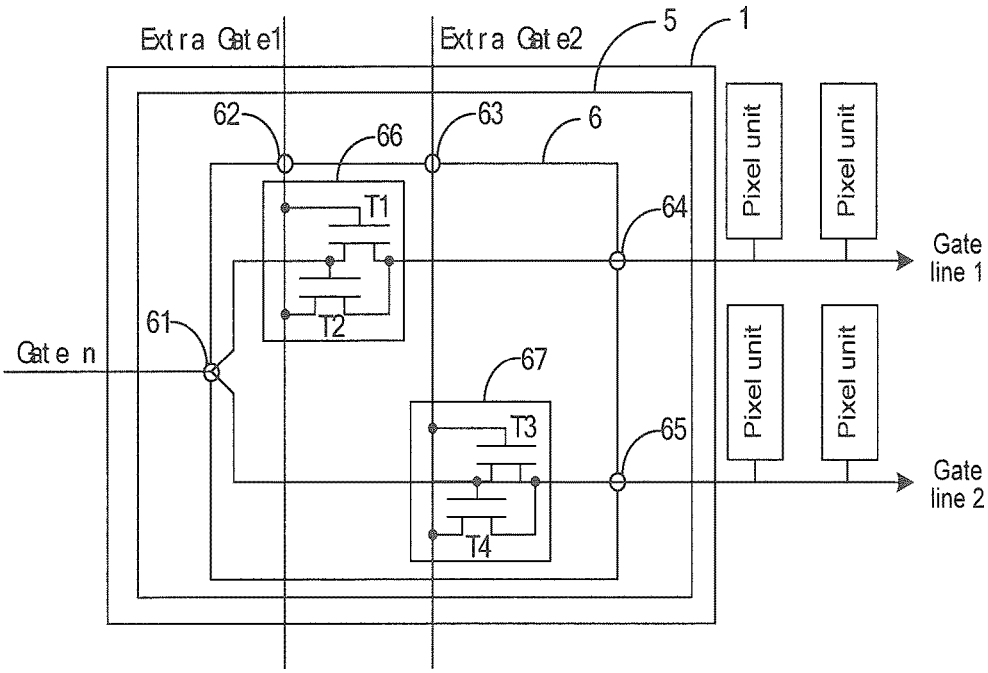
FIG. 7 is yet another schematic view showing the signal splitting system according to one embodiment of the present invention.

In another embodiment, as shown in FIG. 7, the signal decomposition module 6 may comprise the first switch unit 66, a second switch unit 67, a first auxiliary control signal input end 62, a second auxiliary control signal input end 63, the first signal output end 64, the second signal output end 65, and the scanning signal input end 61.

The first switch unit 66 may be connected to the scanning signal input end 61, the first auxiliary control signal input end 62 and the first signal output end 61. The second switch unit 67 may be connected to the scanning signal input end 61, the second auxiliary control signal input end 63 and the second signal output end 65.

As compared with the pixel driving circuit as shown in FIG. 4, in this embodiment, the switch unit 67 is added between the scanning signal input end 61 and the second signal output end 65, and meanwhile the second auxiliary control signal input end 63 is added so as to receive the second auxiliary control signal Extra Gate2, which is of a phase opposite to Extra Gate1.

In this embodiment, the switch unit 66 may also include the first TFT T1 and the second TFT T2 as shown in FIG. 4, while the switch unit 67 may include a third TFT T3 and a fourth TFT T4 which are corresponding to the first TFT T1 and the second TFT T2 in FIG. 4.

Figure 8:
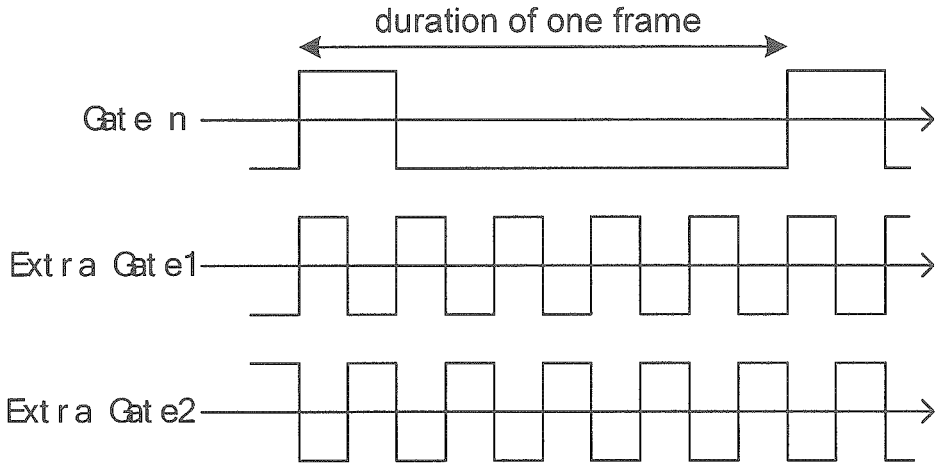
FIG. 8 is another time sequence diagram of signals input to the pixel driving circuit according to one embodiment of the present invention.
Figure 9:
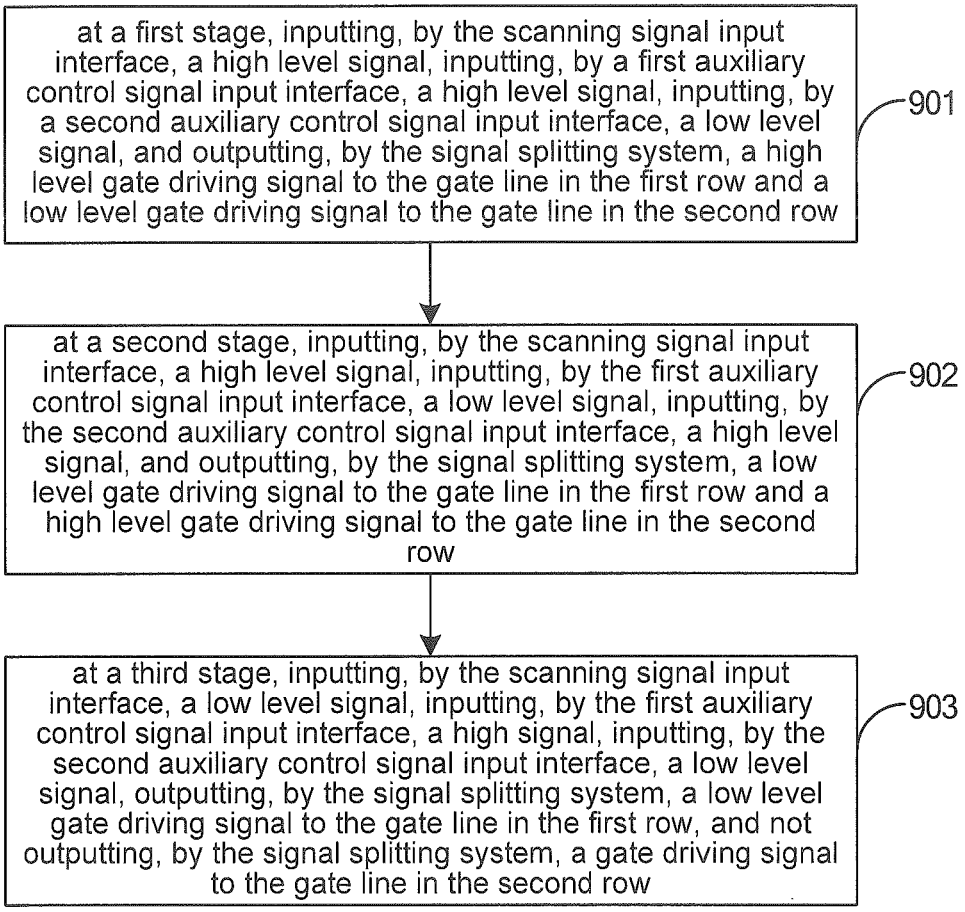
FIG. 9 is another flow chart of the driving method according to one embodiment of the present invention.

FIG. 8 is a sequence diagram of signals input to the pixel driving circuit. As shown in FIG. 9, the driving method may comprise the following steps.

Step 901: at a first stage, inputting, by the scanning signal input interface 2 (i.e., the scanning signal input end 61 of the signal decomposition module 6), a high level signal, inputting, by a first auxiliary control signal input interface (i.e., the first auxiliary control signal input end 62 of the signal decomposition module 6), a high level signal, inputting, by a second auxiliary control signal input interface (i.e., the second auxiliary control signal input end 63 of the signal decomposition module 6), a low level signal, and outputting, by the signal splitting system 1, a high level gate driving signal to the gate line in the first row and a low level gate driving signal to the gate line in the second row.

At this stage, Gate n and Extra Gate1 are at a high level, and Extra Gate2 is at a low level, so the first TFT T1, the second TFT T2 and the fourth TFT T4 are all in the on state, while the third TFT T3 is in the off state. At this time, the high level signals Gate n and Extra Gate1 are transmitted to the first gate line 1, while the low level signal Extra Gate2 is transmitted to the second gate line 2.

Step 902: at a second stage, inputting, by the scanning signal input interface, a high level signal, inputting, by the first auxiliary control signal input interface, a low level signal, inputting, by the second auxiliary control signal input interface, a high level signal, and outputting, by the signal splitting system, a low level gate driving signal to the gate line in the first row and a high level gate driving signal to the gate line in the second row.

At this stage, Gate n and Extra Gate2 are at a high level, and Extra Gate1 is at a low level, so the second TFT T2, the third TFT T3 and the fourth TFT T4 are in the on state, while the first TFT T1 is in the off state. At this time, the high level signal Extra Gate1 is transmitted to the first gate line 1, while the high level signals Gate n and Extra Gate2 are transmitted to the second gate line 2.

Step 903: at a third stage, inputting, by the scanning signal input interface, a low level signal, inputting, by the first auxiliary control signal input interface, a high level signal, inputting, by the second auxiliary control signal input interface, a low level signal, outputting, by the signal splitting system, a low level gate driving signal to the gate line in the first row, and not outputting, by the signal splitting system, a gate driving signal to the gate line in the second row.

At this stage, Gate n and Extra Gate2 are at a low level, and Extra Gate1 is at a high level, so the first TFT T1 is in the on state, while the second TFT T2, the third TFT T3 and the fourth TFT T4 are in the off state. At this time, the low level signal Gate n is transmitted to the first gate line 1, and no signal is transmitted to the second gate line 2.

Meanwhile, at the third stage, the signal splitting system 1 corresponding to the original scanning signal transmission line Gate n+1 adjacent to Gate n starts to carry out the operation as mentioned in the first stage, i.e., outputting the high level signal Gate n+1 to the third gate line 3 as a gate driving signal, and outputting the low level signal Extra Gate2 to the fourth gate line 4 as agate driving signal.

In a later part of the duration of one frame, Gate n is always at a low level, so the second TFT T2 and the fourth TFT T4 are always in the off state. The first TFT T1 and the second TFT T2 will be turned on or off periodically by Extra Gate1 and Extra Gate2, so that the low level signal Gate n is periodically transmitted to the first line 1 and the second gate line 2.

According to the pixel driving circuit of an embodiment of the present invention, the signal splitting system is provided, so as to reduce half of the original scanning signal transmission lines in the case that two auxiliary control signal transmission lines are added, thereby to provide the "narrow-bezel" display device without affecting the progressive scan.

Figure 10:
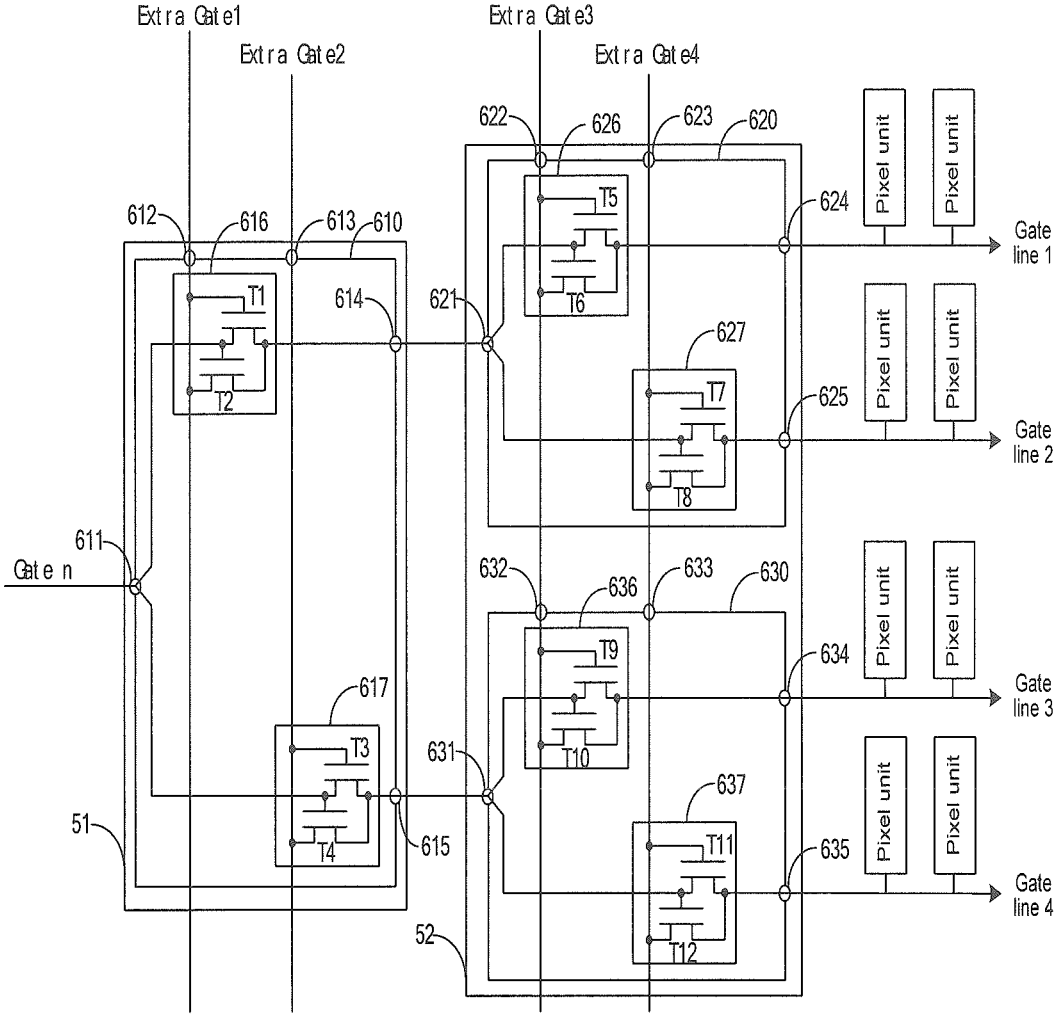
FIG. 10 is yet another schematic view showing the signal splitting system according to one embodiment of the present invention.

In yet another embodiment, as shown in FIG. 10, the signal splitting system 1 may comprise a first-level signal splitting subsystem 51 and a second-level signal splitting subsystem 52. The first-level signal splitting subsystem 51 includes a first signal decomposition module 610, and the second-level signal splitting subsystem 52 includes a second signal decomposition module 620 and a third signal decomposition module 630.

The first signal decomposition module 610 includes a first switch unit 616 and a second switch unit 617. The first switch unit 616 is connected to a scanning signal input end 611 of the first signal decomposition module 610, a first auxiliary control signal input end 612 (for receiving the first auxiliary control signal Extra Gate1), and a first signal output end 614 of the first signal decomposition module 610. The second switch unit 617 is connected to the scanning signal input end 611 of the first signal decomposition module 610, a second auxiliary control signal input end 613 (for receiving the second auxiliary control signal Extra Gate2), and a second signal output end 615 of the first signal decomposition module 610. The scanning signal input end 611 of the first signal decomposition module 610 is connected to the original scanning signal transmission line so as to receive the original scanning signal Gate n.

The first switch unit 616 includes the first TFT T1 and the second TFT T2, and the second switch unit 617 includes the third TFT T3 and the fourth TFT T4.

The second signal decomposition module 620 includes a third switch unit 626 and a fourth switch unit 627. The third switch unit 626 is connected to a scanning signal input end 621 of the second signal decomposition module 620, a third auxiliary control signal input end 622 (for receiving a third auxiliary control signal Extra Gate3), and a first signal output end 624 of the second signal decomposition module 620. The fourth switch unit 627 is connected to the scanning signal input end 621 of the second signal decomposition module 620, a fourth auxiliary control signal input end 623 (for receiving a fourth auxiliary control signal Extra Gate4), and a second signal output end 625 of the second signal decomposition module 620. The scanning signal input end 621 of the second signal decomposition module 620 is connected to the first signal output end 614 of the first signal decomposition module 610. The first signal output end 624 of the second decomposition module 620 is connected to the first gate line 1, and the second signal output end 625 of the second signal decomposition module 620 is connected to the second gate line 2.

The third switch unit 626 includes a fifth TFT T5 and a sixth TFT T6, and the fourth switch unit 627 includes a seventh TFT T7 and an eighth TFT T8.

The third signal decomposition module 630 includes a fifth switch unit 636 and a sixth switch unit 637. The fifth switch unit 636 is connected to a scanning signal input end 631 of the third signal decomposition module 630, a third auxiliary control signal input end 632, and a first signal output end 634 of the third signal decomposition module 630. The sixth switch unit 637 is connected to the scanning signal input end 631 of the third signal decomposition module 630, a fourth auxiliary control signal input end 633, and a second signal output end 635 of the third signal decomposition module 630. The scanning signal input end 631 of the third signal decomposition module 630 is connected to the second signal output end 615 of the first signal decomposition module 610. The first signal output end 634 of the third signal decomposition module 630 is connected to the third gate line 3, and the second signal output end 635 of the third signal decomposition module 630 is connected to the fourth gate line 4.

The fifth switch unit 636 includes a ninth TFT T9 and a tenth TFT T10, and the sixth switch unit 637 includes an eleventh TFT T11 and a twelfth TFT T12.

Figure 11:
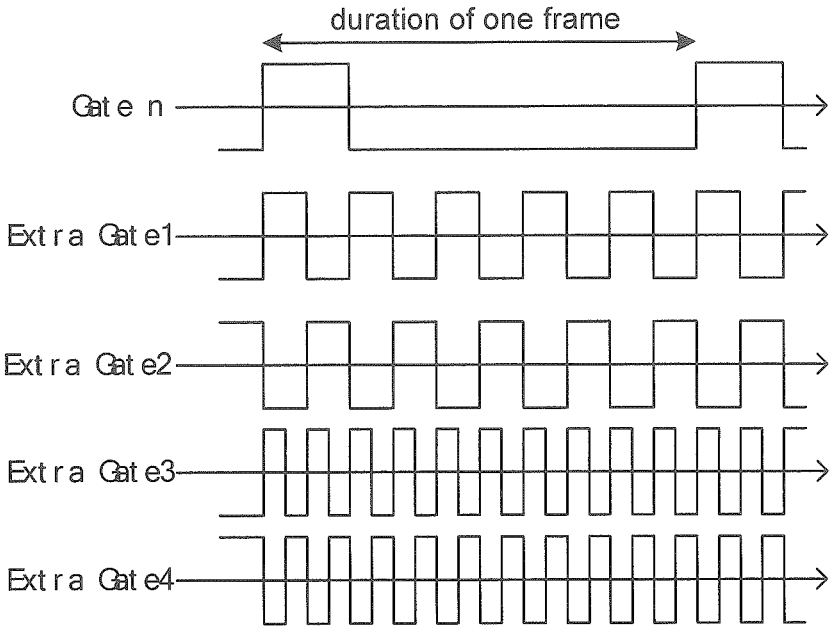
FIG. 11 is yet another time sequence diagram of signals input to the pixel driving circuit according to one embodiment of the present invention.
Figure 12:
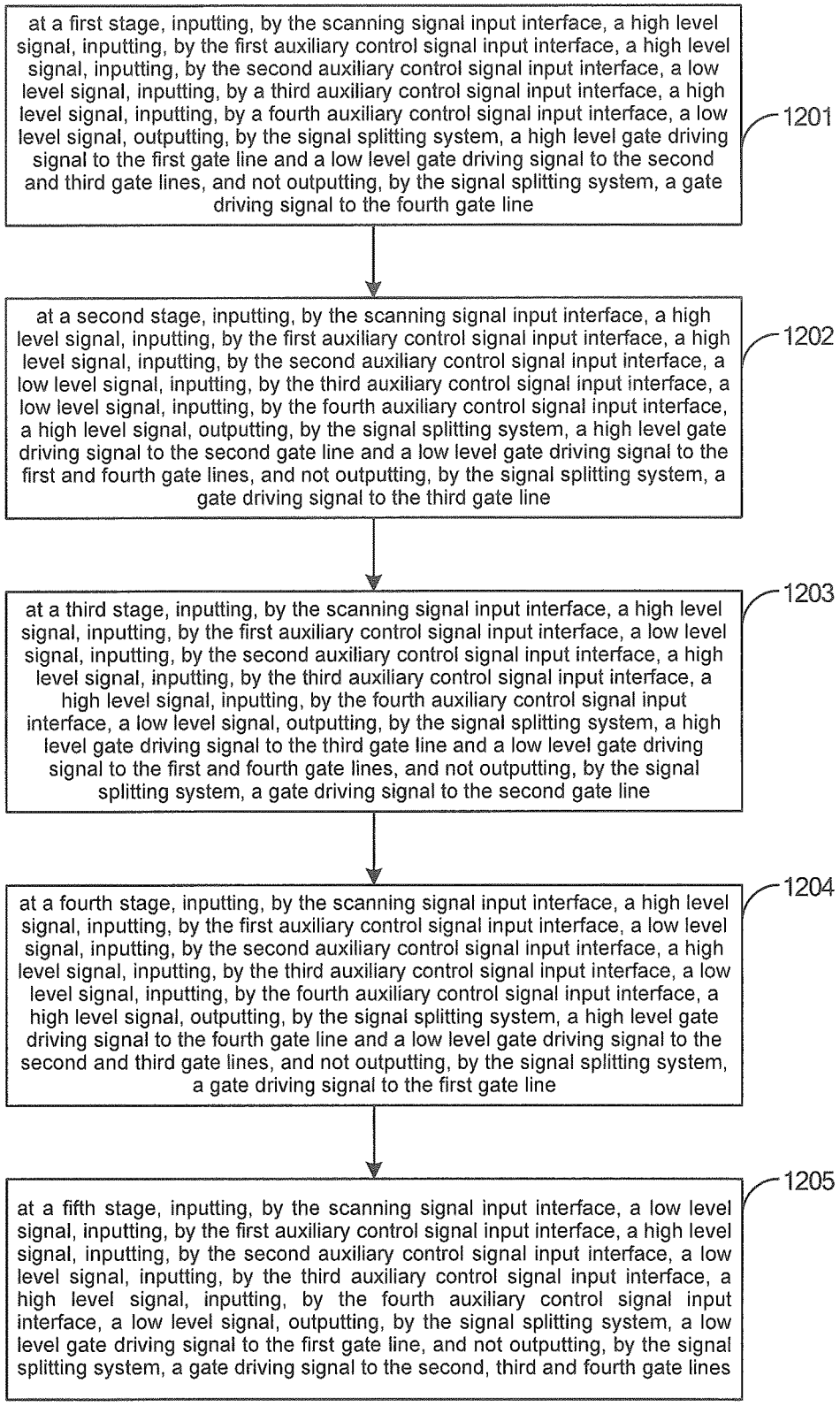
FIG. 12 is yet another flow chart of the driving method according to one embodiment of the present invention.

FIG. 11 shows a sequence diagram of signals input to the pixel driving circuit. As shown in FIG. 12, the driving method may comprise the following steps.

Step 1201: at a first stage, inputting, by the scanning signal input interface 2 (i.e., the scanning signal input end 611 of the first signal decomposition module 610), a high level signal, inputting, by the first auxiliary control signal input interface (i.e., the first auxiliary control signal input end 612 of the first signal decomposition module 610), a high level signal, inputting, by the second auxiliary control signal input interface (i.e., the second auxiliary control signal input end 613 of the first signal decomposition module 610), a low level signal, inputting, by a third auxiliary control signal input interface (i.e., the first auxiliary control signal input end 622 of the second signal decomposition module 620 or the first auxiliary control signal input end 632 of the third signal decomposition module 630), a high level signal, inputting, by a fourth auxiliary control signal input interface (i.e., the second auxiliary control signal input end 623 of the second signal decomposition module 620 or the second auxiliary control signal input end 633 of the third signal decomposition module 630), a low level signal, outputting, by the signal splitting system, a high level gate driving signal to the first gate line 1 and a low level gate driving signal to the second gate line 2 and the third gate line 3, and not outputting, by the signal splitting system, agate driving signal to the fourth gate line 4.

At this stage, the on or off state of the TFTs is similar to those mentioned hereinabove, and it will not be repeated herein.

Step 1202: at a second stage, inputting, by the scanning signal input interface 2, a high level signal, inputting, by the first auxiliary control signal input interface, a high level signal, inputting, by the second auxiliary control signal input interface, a low level signal, inputting, by the third auxiliary control signal input interface, a low level signal, inputting, by the fourth auxiliary control signal input interface, a high level signal, outputting, by the signal splitting system 1, a high level gate driving signal to the second gate line 2 and a low level gate driving signal to the first gate 1 and the fourth gate line 4, and not outputting, by the signal splitting system, agate driving signal to the third gate line 3.

Step 1203: at a third stage, inputting, by the scanning signal input interface 2, a high level signal, inputting, by the first auxiliary control signal input interface, a low level signal, inputting, by the second auxiliary control signal input interface, a high level signal, inputting, by the third auxiliary control signal input interface, a high level signal, inputting, by the fourth auxiliary control signal input interface, a low level signal, outputting, by the signal splitting system 1, a high level gate driving signal to the third gate line 3 and a low level gate driving signal to the first gate line 1 and the fourth gate line 4, and not outputting, by the signal splitting system 1, agate driving signal to the second gate line 2.

Step 1204: at a fourth stage, inputting, by the scanning signal input interface 2, a high level signal, inputting, by the first auxiliary control signal input interface, a low level signal, inputting, by the second auxiliary control signal input interface, a high level signal, inputting, by the third auxiliary control signal input interface, a low level signal, inputting, by the fourth auxiliary control signal input interface, a high level signal, outputting, by the signal splitting system 1, a high level gate driving signal to the fourth gate line 4 and a low level gate driving signal to the second gate line 2 and the third gate line 3, and not outputting, by the signal splitting system 1, agate driving signal to the first gate line 1.

Step 1205: at a fifth stage, inputting, by the scanning signal input interface 2, a low level signal, inputting, by the first auxiliary control signal input interface, a high level signal, inputting, by the second auxiliary control signal input interface, a low level signal, inputting, by the third auxiliary control signal input interface, a high level signal, inputting, by the fourth auxiliary control signal input interface, a low level signal, outputting, by the signal splitting system 1, a low level gate driving signal to the first gate line 1, and not outputting, by the signal splitting system, agate driving signal to the second gate line 2, the third gate line 3 and the fourth gate line 4.

According to the pixel driving circuit of this embodiment, four auxiliary control signal transmission lines are provides, and the signal splitting system 1 is provided with two levels of the signal splitting subsystems. As a result, it is able to reduce three quarters of the original scanning signal transmission lines, thereby to provide the "narrow-bezel" display device.

In yet another embodiment, M may have a value of 2n, and n is not less than 1.

Figure 13:
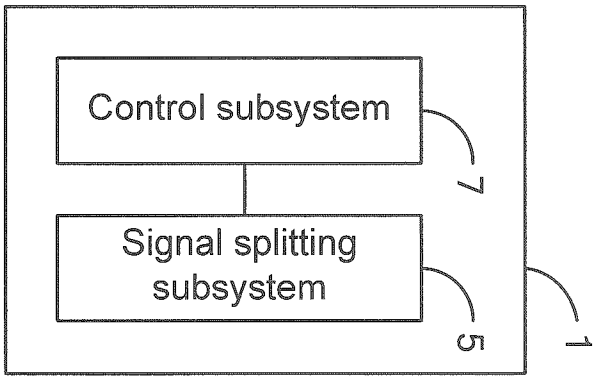
FIG. 13 is yet another schematic view showing the signal splitting system according to one embodiment of the present invention.

As shown in FIG. 13, the signal splitting system 1 may comprise a control subsystem 7 and the signal splitting subsystem 5.

The control subsystem 7 includes a scanning signal input end 71, and n auxiliary control signal input ends 72, n signal output ends 73 and n switch units 76 which are arranged in a one-to-one correspondence manner. The scanning signal input end 71 is connected to the original scanning signal (Gate n) transmission line, the n auxiliary control signal (Extra Gate) input ends are connected to different auxiliary control signal (Extra Gate) transmission lines, and the n signal output ends 73 are connected to the signal splitting subsystem 5. The control subsystem 7 is configured to control the receipt of the original scanning signal (Gate n) by the signal splitting subsystem 5.

The signal splitting subsystem 5 includes n signal decomposition modules 6, each of which is configured to decompose the received original scanning signal (Gate n) into two continuous signals and output them to the corresponding gate lines of 2n rows of gate lines. The signal output from the signal decomposition module 6 has a width half of that of the original scanning signal ((Gate n).

Figure 14:
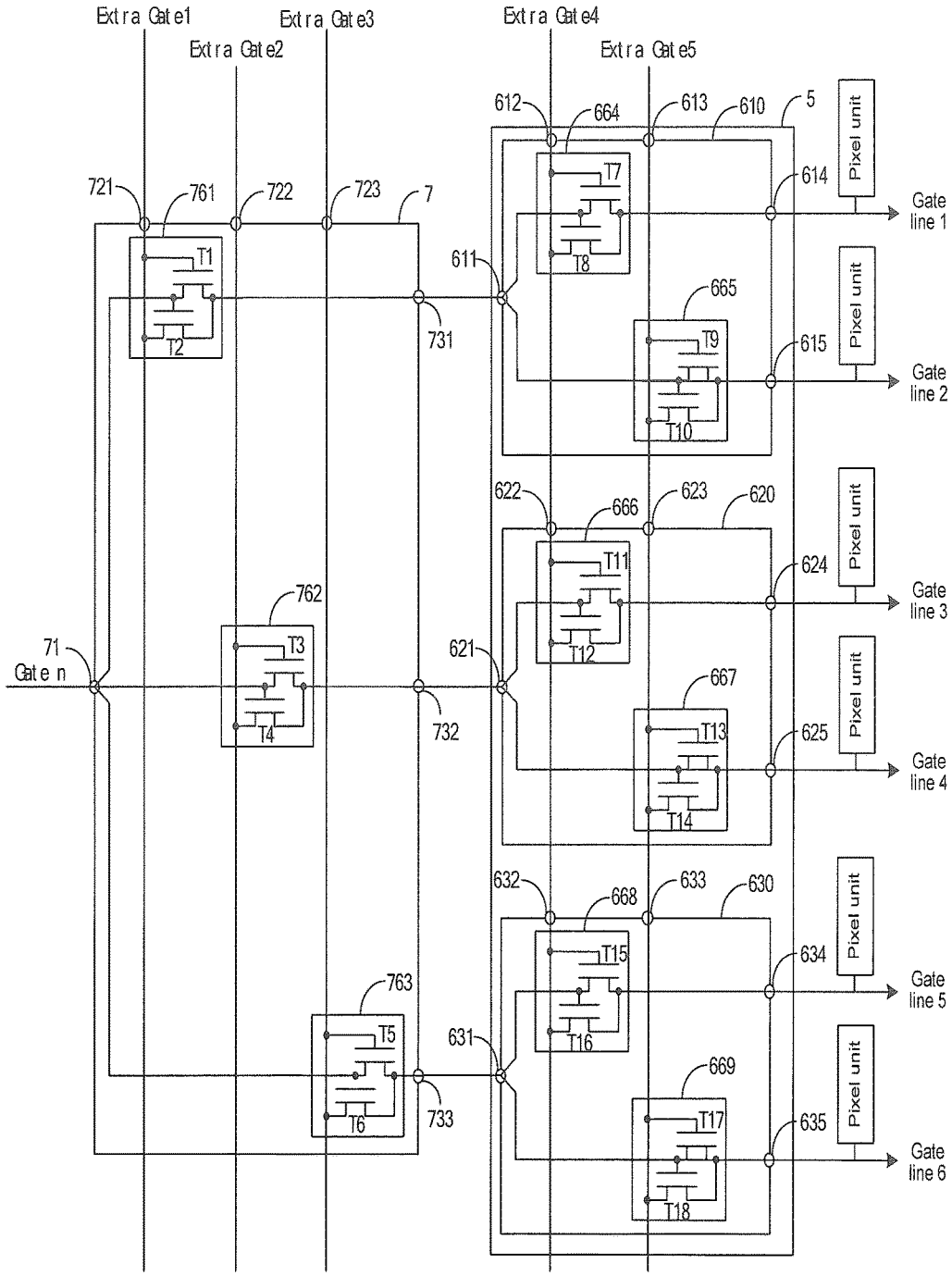
FIG. 14 is yet another schematic view showing the signal splitting system according to one embodiment of the present invention.

In an embodiment, as shown in FIG. 14, the control subsystem 7 may comprise a first switch unit 761, a second switch unit 762 and a third switch unit 763. The first switch unit 761 is connected to a scanning signal input end 71, a first auxiliary control signal input end 721 and a first signal output end 731 of the control subsystem 7, and the first signal output end 731 is connected to the signal splitting subsystem 5. The second switch unit 762 is connected to the scanning signal input end 71, a second auxiliary control signal input end 722 and a second signal output end 732 of the control subsystem 7, and the second signal output end 732 is connected to the signal splitting subsystem 5. The third switch unit 763 is connected to the scanning signal input end 71, a third auxiliary signal input end 723 and a third signal output end 733 of the control subsystem 7, and the third signal output end 733 is connected to the signal splitting subsystem 5.

As shown in FIG. 14, the signal splitting subsystem 5 may comprise the first signal decomposition module 610, the second signal decomposition module 620 and the third signal decomposition module 630.

The first signal decomposition module 610 includes a fourth switch unit 664 and a fifth switch unit 665. The fourth switch unit 664 is connected to the scanning signal input end 611 of the first signal decomposition module 610, the fourth auxiliary control signal input end 612, and the first signal output end 614 of the first signal decomposition module 610. The second switch unit 665 is connected to the scanning signal input end 611 of the first signal decomposition module 610, the fifth auxiliary control signal input end 613, and the second signal output end 615 of the first signal decomposition module 610. The scanning signal input end 611 of the first signal decomposition module 610 is connected to the first signal output end 731 of the control subsystem 7. The first signal output end 614 of the first signal decomposition module 610 is connected to the first gate line 1, and the second signal output end 615 of the first signal decomposition module 610 is connected to the second gate line 2.

The second signal composition module 620 includes a sixth switch unit 666 and a seventh switch unit 667. The sixth switch unit 666 is connected to the scanning signal input end 621 of the second signal decomposition module 620, the fourth auxiliary control signal input end 622, and the first signal output end 624 of the second signal decomposition module 620. The seventh switch unit 667 is connected to the scanning signal input end 621 of the second signal decomposition module 620, the fifth auxiliary control signal input end 623, and the second signal output end 625 of the second signal decomposition module 620. The scanning signal input end 621 of the second signal decomposition module 620 is connected to the second signal output end 732 of the control subsystem 7. The first signal output end 624 of the second signal decomposition module 620 is connected to the third gate line 3, and the second signal output end 625 of the second decomposition module 620 is connected to the fourth gate line 4.

The third signal decomposition module 630 includes an eighth switch unit 668 and a ninth switch unit 669. The eighth switch unit 668 is connected to the scanning signal input end 631 of the third signal decomposition module 630, the fourth auxiliary control signal input end 632, and the first signal output end 634 of the third signal decomposition module 630. The ninth switch unit 669 is connected to the scanning signal input end 631 of the third signal decomposition module 630, the fifth auxiliary control signal input end 633, and the second signal output end 635 of the third signal decomposition module 630. The scanning signal input end 631 of the third signal decomposition module 630 is connected to the third signal output end 733 of the control subsystem 7. The first signal output end 634 of the third signal decomposition module 630 is connected to a fifth gate line 5, and the second signal output end 635 of the third signal decomposition module 630 is connected to a sixth gate line 6.

Each of the switch units in FIG. 14 may also include two TFTs. To be specific, a first switch unit 741 includes the first TFT T1 and the second TFT T2, a second switch unit 742 includes the third TFT T3 and the fourth TFT T4, a third switch unit 743 includes the fifth TFT T5 and the sixth TFT T6, the fourth switch unit 664 includes the seventh TFT T7 and the eighth TFT T8, the fifth switch unit 665 includes the ninth TFT T9 and the tenth TFT T10, the sixth switch unit 666 includes the eleventh TFT T11 and the twelfth TFT T12, the seventh switch unit 667 includes a thirteenth TFT T13 and a fourteenth TFT T14, the eighth switch unit 668 includes a fifteenth TFT T15 and a sixteenth TFT T16, and the ninth switch unit 669 includes a seventeenth TFT T17 and an eighteenth TFT T18.

As shown in FIG. 14, for each switch unit, the gate electrode of one TFT is connected to the auxiliary control signal input end, and the source electrode thereof is connected to the scanning signal input end. The gate electrode of the other TFT is connected to the scanning signal input end, and the source electrode thereof is connected to the auxiliary control signal input end. The drain electrodes of the two TFTs are connected to a signal output end.

Figure 15:
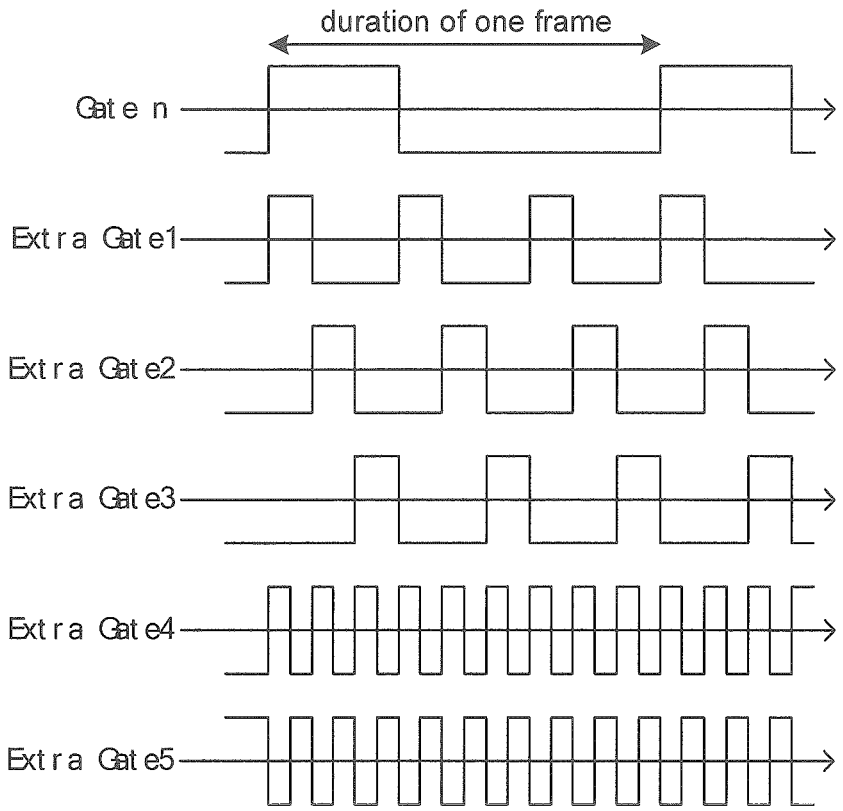
FIG. 15 is yet another time sequence diagram of signals input to the pixel driving circuit according to one embodiment of the present invention.
Figure 16:
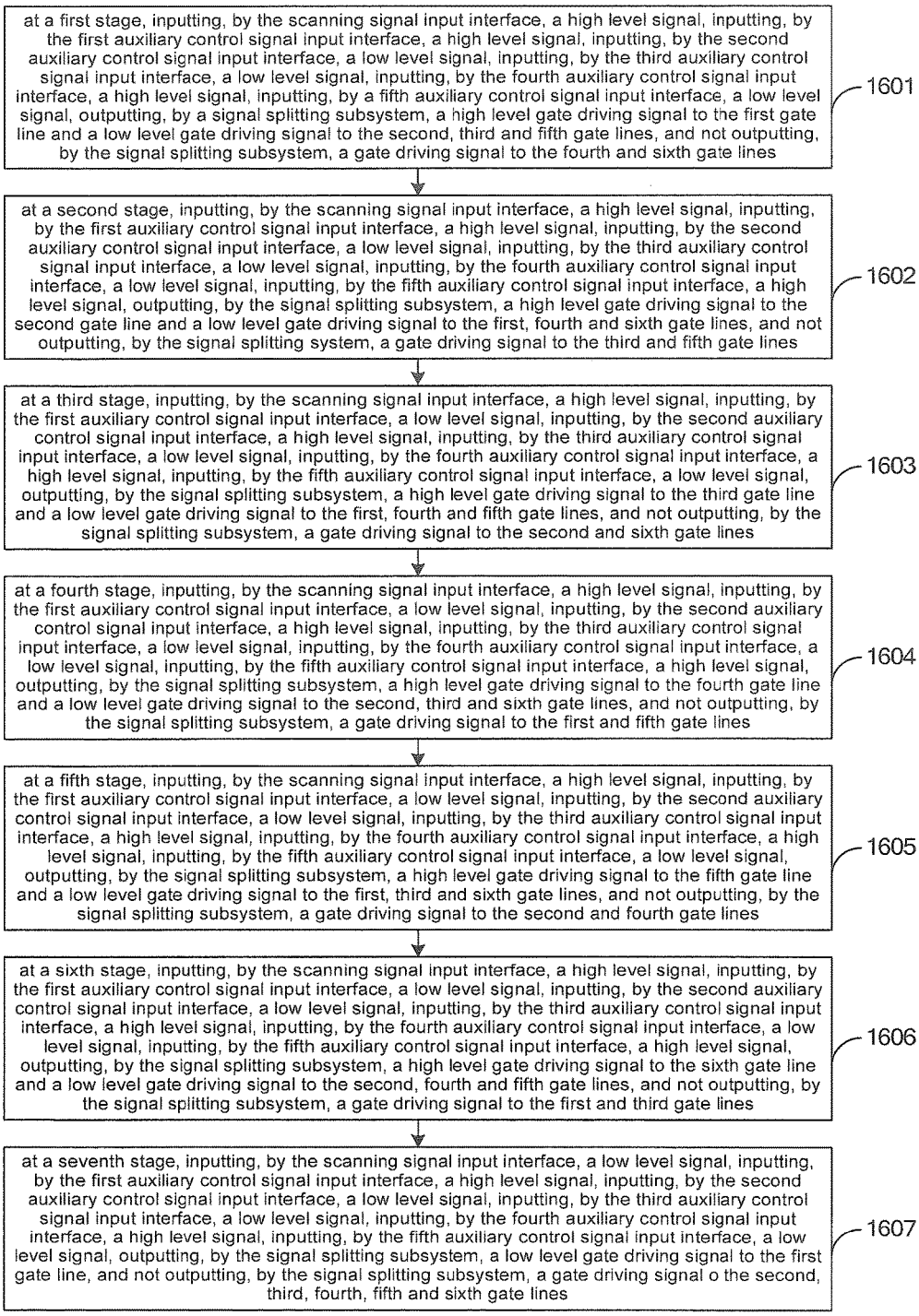
FIG. 16 is yet another flow chart of the driving method according to one embodiment of the present invention.

FIG. 15 is a sequence diagram of signals input to the pixel driving circuit. As shown in FIG. 16, the driving method may comprise the following steps.

Step 1601: at a first stage, inputting, by the scanning signal input interface 2, a high level signal, inputting, by the first auxiliary control signal input interface, a high level signal, inputting, by the second auxiliary control signal input interface, a low level signal, inputting, by the third auxiliary control signal input interface, a low level signal, inputting, by the fourth auxiliary control signal input interface, a high level signal, inputting, by a fifth auxiliary control signal input interface, a low level signal, outputting, by a signal splitting subsystem 5, a high level gate driving signal to the first gate line 1 and a low level gate driving signal to the second gate line 2, the third gate line 3 and the fifth gate line 5, and not outputting, by the signal splitting subsystem 5, a gate driving signal to the fourth gate line 4 and the sixth gate line 6.

Step 1602: at a second stage, inputting, by the scanning signal input interface 2, a high level signal, inputting, by the first auxiliary control signal input interface, a high level signal, inputting, by the second auxiliary control signal input interface, a low level signal, inputting, by the third auxiliary control signal input interface, a low level signal, inputting, by the fourth auxiliary control signal input interface, a low level signal, inputting, by a fifth auxiliary control signal input interface, a high level signal, outputting, by a signal splitting subsystem 5, a high level gate driving signal to the second gate line 2 and a low level gate driving signal to the first gate line 1, the fourth gate line 4 and the sixth gate line 6, and not outputting, by the signal splitting subsystem 5, a gate driving signal to the third gate line 3 and the fifth gate line 5.

Step 1603: at a third stage, inputting, by the scanning signal input interface 2, a high level signal, inputting, by the first auxiliary control signal input interface, a low level signal, inputting, by the second auxiliary control signal input interface, a high level signal, inputting, by the third auxiliary control signal input interface, a low level signal, inputting, by the fourth auxiliary control signal input interface, a high level signal, inputting, by the fifth auxiliary control signal input interface, a low level signal, outputting, by the signal splitting subsystem 5, a high level gate driving signal to the third gate line 3 and a low level gate driving signal to the first gate line 1, the fourth gate line 4 and the fifth gate line 5, and not outputting, by the signal splitting subsystem 5, a gate driving signal to the second gate line 2 and the sixth gate line 6.

Step 1604: at a fourth stage, inputting, by the scanning signal input interface 2, a high level signal, inputting, by the first auxiliary control signal input interface, a low level signal, inputting, by the second auxiliary control signal input interface, a high level signal, inputting, by the third auxiliary control signal input interface, a low level signal, inputting, by the fourth auxiliary control signal input interface, a low level signal, inputting, by the fifth auxiliary control signal input interface, a high level signal, outputting, by the signal splitting subsystem 5, a high level gate driving signal to the fourth gate line 4 and a low level gate driving signal to the second gate line 2, the third gate line 3 and the sixth gate line 6, and not outputting, by the signal splitting subsystem 5, a gate driving signal to the first gate line 1 and the fifth gate line 5.

Step 1605: at a fifth stage, inputting, by the scanning signal input interface 2, a high level signal, inputting, by the first auxiliary control signal input interface, a low level signal, inputting, by the second auxiliary control signal input interface, a low level signal, inputting, by the third auxiliary control signal input interface, a high level signal, inputting, by the fourth auxiliary control signal input interface, a high level signal, inputting, by the fifth auxiliary control signal input interface, a low level signal, outputting, by the signal splitting subsystem 5, a high level gate driving signal to the fifth gate line 5 and a low level gate driving signal to the first gate line 1, the third gate line 3 and the sixth gate line 6, and not outputting, by the signal splitting subsystem 5, a gate driving signal to the second gate line 2 and the fourth gate line 4.

Step 1606: at a sixth stage, inputting, by the scanning signal input interface 2, a high level signal, inputting, by the first auxiliary control signal input interface, a low level signal, inputting, by the second auxiliary control signal input interface, a low level signal, inputting, by the third auxiliary control signal input interface, a high level signal, inputting, by the fourth auxiliary control signal input interface, a low level signal, inputting, by the fifth auxiliary control signal input interface, a high level signal, outputting, by the signal splitting subsystem 5, a high level gate driving signal to the sixth gate line 6 and a low level gate driving signal to the second gate line 2, the fourth gate line 4 and the fifth gate line 5, and not outputting, by the signal splitting subsystem 5, a gate driving signal to the first gate line 1 and the third gate line 3.

Step 1607: at a seventh stage, inputting, by the scanning signal input interface 2, a low level signal, inputting, by the first auxiliary control signal input interface, a high level signal, inputting, by the second auxiliary control signal input interface, a low level signal, inputting, by the third auxiliary control signal input interface, a low level signal, inputting, by the fourth auxiliary control signal input interface, a high level signal, inputting, by the fifth auxiliary control signal input interface, a low level signal, outputting, by the signal splitting subsystem 5, a low level gate driving signal to the first gate line 1, and not outputting, by the signal splitting subsystem 5, a gate driving signal to the second gate line 2, the third gate line 3, the fourth gate line 4, the fifth gate line 5 and the sixth gate line 6.

In this embodiment, the corresponding sequence control signals are input, so as to control the on or off state of each switch unit in the control subsystem 7 and the signal splitting subsystem 5, thereby to output different gate signals to the 2n rows of gate lines. In addition, in this embodiment, one scanning signal line can be used to control at least two rows of gate lines. As a result, it is able to reduce half of the scanning signal lines, thereby to reduce the wiring region of the scanning signal lines and provide the "narrow-bezel" display device.

In the other embodiments, the difference signal splitting systems may be combined together (e.g., the first scanning signal line is connected to the signal splitting system in FIG. 10 while the second scanning signal line is connected to the signal splitting system in FIG. 14, or the first scanning signal line is directly connected to a gate line while the second scanning signal line is connected to the signal splitting system in FIG. 10 or 14), and meanwhile the sequence of the input signals may be designed, so as to reduce the number of the scanning signal lines, thereby to reduce the wiring region of the scanning signal lines and provide the "narrow-bezel" display device.

In these embodiments, M may have a value of $2^n+2n$.

The present disclosure further provides a display panel comprising the above-mentioned pixel driving circuit.

The present disclosure further provides a display device comprising the above-mentioned display panel. The display device may be a liquid crystal panel, a liquid crystal TV, a liquid crystal display, an OLED panel, an OLED display, a plasma display, or an electronic paper.

According to the pixel driving circuit, the driving method, the display panel and the display device of embodiments of the present invention, the pixel driving circuit is provided with a plurality of signal splitting systems comprising the scanning signal input interface for receiving the original scanning signal with a width of MT, the auxiliary control signal input interfaces for receiving the auxiliary control signals and the signal output interfaces connected to the $2^n$ rows of gate lines in a one-to-one correspondence manner. The signal splitting system is configured to split the original scanning signal with a width of $2^n$ T into $2^n$ gate driving signals with a width of the gate line turn-on time T, and output the gate driving signals to the $2^n$ rows of gate lines sequentially via the output interfaces. As a result, it is able to control at least two rows of gate lines by one scanning signal line, thereby to reduce more than half of the scanning signal lines, reduce a wiring region for the scanning signal lines and provide the "narrow-bezel" display device.

The above are merely the preferred embodiments of the present invention. It should be noted that, a person skilled in the art may make further modifications and improvements without departing from the principle of the present invention, and these modifications and improvements shall also be considered as the scope of the present invention.

What is claimed is:

1. A pixel driving circuit, comprising one or more signal splitting circuits, each signal splitting circuit corresponding to continuous M rows of gate lines, M being not less than 2, wherein the signal splitting circuit comprises:

a scanning signal input interface configured to receive an original scanning signal with a time width of MT and connected to an original scanning signal transmission line;

an auxiliary control signal input interface configured to receive an auxiliary control signal and connected to an auxiliary control signal transmission line; and signal output interfaces connected to the M rows of gate lines in an one-to-one correspondence manner, wherein the signal splitting circuit is configured to split the original scanning signal with a width of MT into M gate driving signals with a width of a gate line turn-on time T, and output the gate driving signals to the M rows of gate lines sequentially via the output interfaces, M has a value of 2n, and n is not less than 1, the signal splitting circuit comprises a control subsystem and the signal splitting subsystem, the control subsystem includes a scanning signal input end, and n auxiliary control signal input ends, n signal output ends and n switch units which are arranged in a one-to-one correspondence manner, the scanning signal input end is connected to the original scanning signal transmission line, the n auxiliary control signal input ends are connected to different auxiliary control signal transmission lines, and the n signal output ends are connected to the signal splitting subsystem, and the control subsystem is configured to control the receipt of the original scanning signal by the signal splitting subsystem, the signal splitting subsystem includes n signal decomposition circuits, the signal decomposition circuit is configured to decompose the received original scanning signal into two signals and output them to the corresponding gate lines of the 2n rows of gate lines, each of the two signal output from the signal decomposition circuit has a width half the original scanning signal, the control subsystem includes a first switch unit, a second switch unit and a third switch unit, the first switch unit is connected to the scanning signal input end, a first auxiliary control signal input end and a first signal output end of the control subsystem, and the first signal output end is connected to the signal splitting subsystem, the second switch unit is connected to the scanning signal input end, a second auxiliary control signal input end and a second signal output end of the control subsystem, and the second signal output end is connected to the signal splitting subsystem, the third switch unit is connected to the scanning signal input end, a third auxiliary signal input end and a third signal output end of the control subsystem, and the third signal output end is connected to the signal splitting subsystem, the signal splitting subsystem includes a first signal decomposition circuit, a second signal decomposition circuit and a third signal decomposition circuit, the first signal decomposition circuit includes a fourth switch unit and a fifth switch unit, wherein the fourth switch unit is connected to the scanning signal input end of the first signal decomposition circuit, the fourth auxiliary control signal input end, and the first signal output end of the first signal decomposition circuit, the second switch unit is connected to the scanning signal input end of the first signal decomposition circuit, a fifth auxiliary control signal input end, and the second signal output end of the first signal decomposition circuit, the scanning signal input end of the first signal decomposition circuit is connected to the first signal output end of the control subsystem, the first signal output end of the first signal decomposition circuit is connected to the first gate line, and the second signal output end of the first signal decomposition circuit is connected to the second gate line, the second signal composition circuit includes a sixth switch unit and a seventh switch unit, wherein the sixth switch unit is connected to the scanning signal input end of the second signal decomposition circuit, the fourth auxiliary control signal input end, and the first signal output end of the second signal decomposition circuit, the seventh switch unit is connected to the scanning signal input end of the second signal decomposition circuit, the fifth auxiliary control signal input end, and the second signal output end of the second signal decomposition circuit, the scanning signal input end of the second signal decomposition circuit is connected to the second signal output end of the control subsystem, the first signal output end of the second signal decomposition circuit is connected to the third gate line, and the second signal output end of the second decomposition circuit is connected to the fourth gate line, and the third signal decomposition circuit includes an eighth switch unit and a ninth switch unit, wherein the eighth switch unit is connected to the scanning signal input end of the third signal decomposition circuit, the fourth auxiliary control signal input end, and the first signal output end of the third signal decomposition circuit, the ninth switch unit is connected to the scanning signal input end of the third signal decomposition circuit, the fifth auxiliary control signal input end, and the second signal output end of the third signal decomposition circuit, the scanning signal input end of the third signal decomposition circuit is connected to the third signal output end of the control subsystem, the first signal output end of the third signal decomposition circuit is connected to a fifth gate line, and the second signal output end of the third signal decomposition circuit is connected to a sixth gate line.

2. The pixel driving circuit according to claim 1, wherein the signal decomposition circuit comprises a scanning signal input end, at least one auxiliary control signal input end, two signal output ends, and at least one switch unit.

3. The pixel driving circuit according to claim 2, wherein the scanning signal input end of the signal decomposition circuit in a first-level signal splitting subsystem is connected to the original scanning signal transmission line and configured to receive the original scanning signal, and the scanning signal input end of the signal decomposition circuit in the signal splitting subsystems other than the first-level signal splitting subsystem is connected to the signal output end of the signal decomposition circuit in a previous-level signal splitting subsystem and configured to receive a signal output from the signal decomposition circuit in the previous-level signal splitting subsystem, the auxiliary control signal input end is connected to the auxiliary control signal transmission line and configured to receive the auxiliary control signal, the auxiliary control signal input ends are arranged in one-to-one correspondence with the switch units, and when there is a plurality of auxiliary control signal input ends, they are connected to different auxiliary control signal transmission lines and receive different auxiliary control signals, two signal output ends of the signal decomposition circuit in the signal splitting subsystems other than a last-level signal splitting subsystem are connected to the scanning signal input ends of two adjacent signal decomposition circuits in a next-level signal splitting subsystem, respectively, and the two signal output ends of the signal decomposition circuit in the last-level signal splitting subsystem are connected to the two adjacent rows of gate lines, respectively, and one of the at least one switch unit is connected to the scanning signal input end, the auxiliary control signal input end and the signal output end.

4. The pixel driving circuit according to claim 1, wherein each of the first switch unit, the second switch unit, the third switch unit, the fourth switch unit, the fifth switch unit and the sixth switch unit includes a first TFT and a second TFT, a gate electrode of the first TFT is connected to the auxiliary control signal input end, and a source electrode of the first TFT is connected to the scanning signal input end, a gate electrode of the second TFT is connected to the scanning signal input end, and a source electrode of the second TFT is connected to the auxiliary control signal input end, and a drain electrode of the first TFT and a drain electrode of the second TFT are connected to a signal output end.

5. A method for driving a pixel driving circuit according to claim 1, comprising the step of:

under the control of an original scanning signal with a time width of MT and one or more auxiliary control signals, splitting, by the signal splitting circuit, the original scanning signal with a width of MT into M gate driving signals with a width of a gate line turn-on time T, and outputting the gate driving signals to M rows of gate lines sequentially.

6. The driving method according to claim 5, wherein the step of, under the control of an original scanning signal with a width of MT and one auxiliary control signal, splitting, by a signal splitting circuit, the original scanning signal with a width of MT into M gate driving signals with a width of a gate line turn-on time T, and outputting the gate driving signals to M rows of gate lines sequentially comprises:

at a first stage, inputting, by a scanning signal input interface, a high level signal, inputting, by an auxiliary control signal input interface, a high level signal, and outputting, by the signal splitting circuit, a same high level gate driving signal to both the gate line in the first row and the gate line in the second row;

at a second stage, inputting, by the scanning signal input interface, a high level signal, inputting, by the auxiliary control signal input interface, a low level signal, and outputting, by the signal splitting circuit, a low level gate driving signal to the gate line in the first row and a high level gate driving signal to the gate line in the second row; and at a third stage, inputting, by the scanning signal input interface, a low level signal, inputting, by the auxiliary control signal input interface, a high level signal, and outputting, by the signal splitting circuit, a low level gate driving signal to the gate line in the first row and a low level gate driving signal to the gate line in the second row.

7. The driving method according to claim 5, wherein the step of, under the control of an original scanning signal with a width of MT and a plurality of auxiliary control signals, splitting, by a signal splitting circuit, the original scanning signal with a width of MT into M gate driving signals with a width of a gate line turn-on time T, and outputting the gate driving signals to M rows of gate lines sequentially comprises:

at a first stage, the plurality of auxiliary control signals being a first auxiliary control signal and a second auxiliary control signal, inputting, by a scanning signal input interface, a high level signal, inputting, by a first auxiliary control signal input interface, a high level signal, inputting, by a second auxiliary control signal input interface, a low level signal, and outputting, by the signal splitting circuit, a high level gate driving signal to the gate line in the first row and a low level gate driving signal to the gate line in the second row;

at a second stage, inputting, by the scanning signal input interface, a high level signal, inputting, by the first auxiliary control signal input interface, a low level signal, inputting, by the second auxiliary control signal input interface, a high level signal, and outputting, by the signal splitting circuit, a low level gate driving signal to the gate line in the first row and a high level gate driving signal to the gate line in the second row; and at a third stage, inputting, by the scanning signal input interface, a low level signal, inputting, by the first auxiliary control signal input interface, a high signal, inputting, by the second auxiliary control signal input interface, a low level signal, outputting, by the signal splitting circuit, a low level gate driving signal to the gate line in the first row, and not outputting, by the signal splitting circuit, a gate driving signal to the gate line in the second row.

8. The driving method according to claim 5, wherein the step of, under the control of an original scanning signal with a width of MT and a plurality of auxiliary control signals, splitting, by a signal splitting circuit, the original scanning signal with a width of MT into M gate driving signals with a width of a gate line turn-on time T, and outputting the gate driving signals to M rows of gate lines sequentially comprises:

at a first stage, the plurality of auxiliary control signals being a first auxiliary control signal, a second auxiliary control signal, a third auxiliary control signal and a fourth auxiliary control signal, inputting, by a scanning signal input interface, a high level signal, inputting, by the first auxiliary control signal input interface, a high level signal, inputting, by the second auxiliary control signal input interface, a low level signal, inputting, by a third auxiliary control signal input interface, a high level signal, inputting, by a fourth auxiliary control signal input interface, a low level signal, outputting, by the signal splitting circuit, a high level gate driving signal to a first gate line and a low level gate driving signal to second and third gate lines, and not outputting, by the signal splitting circuit, a gate driving signal to a fourth gate line;

at a second stage, inputting, by the scanning signal input interface, a high level signal, inputting, by the first auxiliary control signal input interface, a high level signal, inputting, by the second auxiliary control signal input interface, a low level signal, inputting, by the third auxiliary control signal input interface, a low level signal, inputting, by the fourth auxiliary control signal input interface, a high level signal, outputting, by the signal splitting circuit, a high level gate driving signal to the second gate line and a low level gate driving signal to the first and fourth gate lines, and not outputting, by the signal splitting circuit, a gate driving signal to the third gate line;

at a third stage, inputting, by the scanning signal input interface, a high level signal, inputting, by the first auxiliary control signal input interface, a low level signal, inputting, by the second auxiliary control signal input interface, a high level signal, inputting, by the third auxiliary control signal input interface, a high level signal, inputting, by the fourth auxiliary control signal input interface, a low level signal, outputting, by the signal splitting circuit, a high level gate driving signal to the third gate line and a low level gate driving signal to the first and fourth gate lines, and not outputting, by the signal splitting circuit, a gate driving signal to the second gate line;

at a fourth stage, inputting, by the scanning signal input interface, a high level signal, inputting, by the first auxiliary control signal input interface, a low level signal, inputting, by the second auxiliary control signal input interface, a high level signal, inputting, by the third auxiliary control signal input interface, a low level signal, inputting, by the fourth auxiliary control signal input interface, a high level signal, outputting, by the signal splitting circuit, a high level gate driving signal to the fourth gate line and a low level gate driving signal to the second and third gate lines, and not outputting, by the signal splitting circuit, a gate driving signal to the first gate line; and at a fifth stage, inputting, by the scanning signal input interface, a low level signal, inputting, by the first auxiliary control signal input interface, a high level signal, inputting, by the second auxiliary control signal input interface, a low level signal, inputting, by the third auxiliary control signal input interface, a high level signal, inputting, by the fourth auxiliary control signal input interface, a low level signal, outputting, by the signal splitting circuit, a low level gate driving signal to the first gate line, and not outputting, by the signal splitting circuit, a gate driving signal to the second, third and fourth gate lines.

9. The driving method according to claim 5, wherein the step of, under the control of an original scanning signal with a width of MT and a plurality of auxiliary control signal, splitting, by a signal splitting circuit, the original scanning signal with a width of MT into M gate driving signals with a width of a gate line turn-on time T, and outputting the gate driving signals to M rows of gate lines sequentially comprises:

at a first stage, the plurality of auxiliary control signals being a first auxiliary control signal, a second auxiliary control signal, a third auxiliary control signal, a fourth auxiliary control signal and a fifth auxiliary control signal, inputting, by a scanning signal input interface, a high level signal, inputting, by the first auxiliary control signal input interface, a high level signal, inputting, by the second auxiliary control signal input interface, a low level signal, inputting, by the third auxiliary control signal input interface, a low level signal, inputting, by the fourth auxiliary control signal input interface, a high level signal, inputting, by a fifth auxiliary control signal input interface, a low level signal, outputting, by a signal splitting subsystem, a high level gate driving signal to the first gate line and a low level gate driving signal to the second and third gate lines and a fifth gate line, and not outputting, by the signal splitting subsystem, a gate driving signal to the fourth gate line and a sixth gate line;

at a second stage, inputting, by the scanning signal input interface, a high level signal, inputting, by the first auxiliary control signal input interface, a high level signal, inputting, by the second auxiliary control signal input interface, a low level signal, inputting, by the third auxiliary control signal input interface, a low level signal, inputting, by the fourth auxiliary control signal input interface, a low level signal, inputting, by the fifth auxiliary control signal input interface, a high level signal, outputting, by the signal splitting subsystem, a high level gate driving signal to the second gate line and a low level gate driving signal to the first, fourth and sixth gate lines, and not outputting, by the signal splitting circuit, a gate driving signal to the third and fifth gate lines;

at a third stage, inputting, by the scanning signal input interface, a high level signal, inputting, by the first auxiliary control signal input interface, a low level signal, inputting, by the second auxiliary control signal input interface, a high level signal, inputting, by the third auxiliary control signal input interface, a low level signal, inputting, by the fourth auxiliary control signal input interface, a high level signal, inputting, by the fifth auxiliary control signal input interface, a low level signal, outputting, by the signal splitting subsystem, a high level gate driving signal to the third gate line and a low level gate driving signal to the first, fourth and fifth gate lines, and not outputting, by the signal splitting subsystem, a gate driving signal to the second and sixth gate lines;

at a fourth stage, inputting, by the scanning signal input interface, a high level signal, inputting, by the first auxiliary control signal input interface, a low level signal, inputting, by the second auxiliary control signal input interface, a high level signal, inputting, by the third auxiliary control signal input interface, a low level signal, inputting, by the fourth auxiliary control signal input interface, a low level signal, inputting, by the fifth auxiliary control signal input interface, a high level signal, outputting, by the signal splitting subsystem, a high level gate driving signal to the fourth gate line and a low level gate driving signal to the second, third and sixth gate lines, and not outputting, by the signal splitting subsystem, a gate driving signal to the first and fifth gate lines;

at a fifth stage, inputting, by the scanning signal input interface, a high level signal, inputting, by the first auxiliary control signal input interface, a low level signal, inputting, by the second auxiliary control signal input interface, a low level signal, inputting, by the third auxiliary control signal input interface, a high level signal, inputting, by the fourth auxiliary control signal input interface, a high level signal, inputting, by the fifth auxiliary control signal input interface, a low level signal, outputting, by the signal splitting subsystem, a high level gate driving signal to the fifth gate line and a low level gate driving signal to the first, third and sixth gate lines, and not outputting, by the signal splitting subsystem, a gate driving signal to the second and fourth gate lines;

at a sixth stage, inputting, by the scanning signal input interface, a high level signal, inputting, by the first auxiliary control signal input interface, a low level signal, inputting, by the second auxiliary control signal input interface, a low level signal, inputting, by the third auxiliary control signal input interface, a high level signal, inputting, by the fourth auxiliary control signal input interface, a low level signal, inputting, by the fifth auxiliary control signal input interface, a high level signal, outputting, by the signal splitting subsystem, a high level gate driving signal to the sixth gate line and a low level gate driving signal to the second, fourth and fifth gate lines, and not outputting, by the signal splitting subsystem, a gate driving signal to the first and third gate lines; and at a seventh stage, inputting, by the scanning signal input interface, a low level signal, inputting, by the first auxiliary control signal input interface, a high level signal, inputting, by the second auxiliary control signal input interface, a low level signal, inputting, by the third auxiliary control signal input interface, a low level signal, inputting, by the fourth auxiliary control signal input interface, a high level signal, inputting, by the fifth auxiliary control signal input interface, a low level signal, outputting, by the signal splitting subsystem, a low level gate driving signal to the first gate line, and not outputting, by the signal splitting subsystem, a gate driving signal to the second, third, fourth, fifth and sixth gate lines.

10. A display device comprising the pixel driving circuit according to claim 1.

* * * * *